US005842082A

United States Patent [19]

Hyakutake et al.

[11] Patent Number: 5,842,082

[45] Date of Patent: Nov. 24, 1998

[54] IMAGE FORMING APPARATUS HAVING INDUCED CHARGE DENSITY SUPPRESSING DEVICE FOR PREVENTING ELECTROSTATIC HYSTERESIS PHENOMENON

[75] Inventors: Nobuo Hyakutake; Yoshihiro Enomoto; Tetsuya Fujita; Kazuhiro Yoshihara, all of Ebina, Japan

[73] Assignee: Fuji Xerox Co., LTD, Tokyo, Japan

[21] Appl. No.: 715,897

[22] Filed: Sep. 19, 1996

[30] Foreign Application Priority Data

Sep. 20, 1995 [JP] Japan ..... 7-242135

[51] Int. Cl.[6] ..... G03G 15/16

[52] U.S. Cl. ..... 399/66; 399/127; 399/302; 399/303

[58] Field of Search ..... 399/303, 66, 127, 399/128, 302, 311

[56] References Cited

U.S. PATENT DOCUMENTS 5,280,325 1/1994 Yamada et al. ..... 399/303

5,552,872 9/1996 Amemiya et al. ..... 399/308

FOREIGN PATENT DOCUMENTS 1-149079 6/1989 Japan .
2-140784 5/1990 Japan .
3-87885 4/1991 Japan .
4-242773 8/1992 Japan .
A-5-61368 3/1993 Japan .
9-90772 4/1997 Japan .

*Primary Examiner*—Arthur T. Grimley
*Assistant Examiner*—Quana Grainger
*Attorney, Agent, or Firm*—Oliff & Berridge, PLC

[57] ABSTRACT

An image forming apparatus which forms an image by transferring a developed image formed on an image holding member onto a transfer material by a transfer unit. The image forming apparatus is further provided with an induced-charge density suppressing unit. This induced-charge density suppressing unit suppresses the density of electric charge induced in the area of the image holding member which is opposite to an image forming member as a result of stoppage of the image forming member that is opposite to the image holding member and is electrostatically charged.

13 Claims, 20 Drawing Sheets

| | TIE-BAR PLATE | TRANSFER FILM SURFACE |
|---|---|---|
| HIGH-TEMP. AND HIGH-HUMIDITY PHENOMENON | △~× | ○ |
| LOW-TEMP. AND LOW-HUMIDITY PHENOMENON | ○ | × |

IMAGE FORMING APPARATUS HAVING INDUCED CHARGE DENSITY SUPPRESSING DEVICE FOR PREVENTING ELECTROSTATIC HYSTERESIS PHENOMENON

BACKGROUND OF THE INVENTION

1. Field of Invention

The present invention relates to an image forming apparatus suitable for use with an electrographic copier or printer that forms a color image by forming a plurality of toner images having different colors on a photosensitive drum one after another. The image forming apparatus transfers these toner images (formed on the photosensitive drum) onto a transfer material retained on the transfer drum while they are superimposed on each other. Particularly, the present invention relates to an image forming apparatus capable of preventing an electrostatic hysteresis phenomenon developed in a photosensitive drum when an image forming member that is charged and is opposite to the photosensitive drum is stopped.

2. Description of Related Art

There is an image forming apparatus that forms a color image by forming a plurality of toner images having different colors (e.g., black, yellow, magenta, and cyan) on a photosensitive drum one after another. This apparatus transfers these toner images formed on the photosensitive drum onto a transfer material, such as transfer paper, supported on a transfer drum while they are superimposed on each other by means of electrostatic charges of a transfer corotron. The image forming apparatus has a predetermined number of toner images that are transferred on the transfer material that is adsorbed on the transfer drum in a superimposed manner. This transfer material is peeled from the surface of transfer drum. The toner images are then fixed on the transfer material by means of a fixing unit.

FIG. 21 shows a transfer drum 100 which is made up of a drum-shaped frame 103. The frame 103 comprises a pair of ring members 101 and 101 (herein after "101" disposed on both longitudinal ends of the 103. The frame 103 also comprises a tie-bar plate 102 made of metal or synthetic resin for connecting the ring members 101, 101 to each other. A transfer film 104 consisting of a dielectric film, such as polyvinylidene fluoride and polyethylene terephthalate, is wrapped around the frame 103 while the circumferential edges of the transfer film 104 are fixed to the tie-bar plate 102. The longitudinal side edges of the transfer film 104 are aligned with the outer peripheries of the ring members 101, respectively. In this case, the circumferential front edge of the transfer film 104 is fixed to the tie-bar plate 102 with screws 105.

The circumferential rear edge of the transfer film 104 is fixed to the tie-bar plate 102 in the following manner. FIGS. 22A and 22B show a rear edge plate 107 which is bonded to the back of the circumferential rear edge of the transfer film 104 with a polyurethane sponge 106 sandwiched between them by means of an adhesive. Substantially U-shaped planer recesses 108 are formed in both the transfer film 104 and the polyurethane sponge 106. Through-holes 109 (for use with screws) are formed in the rear edge plate 107. The through-holes 109 correspond to the recesses 108. Screws 110 are inserted into the through-holes 109. The thus-inserted screws 110 are screwed into internal threads formed in the tie-bar plate 102. As a result, the rear edge of the transfer film 104 is attached to the tie-bar plate 102.

As shown in FIG. 21, the circumferential front and rear edges of the transfer film 104 are fixed to the tie-bar plate 102 when the transfer film 104 is wrapped around the transfer drum 100. Because of such a construction, attachment of the transfer film 104 to the tie-bar plate 102 requires a high degree of positional accuracy. The circumferential front and rear edges of the transfer film 104 must be fixed to the tie-bar plate 102 with the screws 105 and 110. This requires complicated assembly process which adds to manufacturing costs.

According to a method recently employed to solve the above problem, the transfer film 104 is fixedly wrapped around the frame 103 while both longitudinal edges of the transfer film 104 are aligned with the outer peripheries of the ring members 101. The front and rear circumferential edges of the transfer film 104 are not fixed to the tie-bar 102. As shown in FIGS. 23 and 24, a circumferential front edge 104*a* and a circumferential rear edge 104*b* of the transfer film 104 are bonded to a pressure sensitive adhesive double coated tape 120 while the front and rear edges overlap. A toner image formed on the photosensitive drum cannot be properly transferred onto the bonded portion of the transfer film 104. The adhered portion of the transfer film 104 is positioned in a non-image area of the transfer drum 100. That is, the portion of the transfer drum 100 corresponding to the tie-bar plate 102 has a clearance between the tie-bar plate 102 and the bonded portion of the transfer film 104.

In the above construction, the transfer film 104 is coiled around the transfer drum 100, except for the area of the transfer drum 100 corresponding to the tie-bar plate 102. A transfer corotron disposed inside the transfer drum 100 applies electrostatic transfer charges to the transfer film 104. The toner images formed one over another on the photosensitive drum are transferred to a transfer material retained on the transfer drum 100. Thus, the interior surface of the transfer film 104 of the transfer drum 100 receives the electrostatic transfer charges from the transfer corotron, whereas the exterior surface of the transfer film 104 receives electric discharge developed when the transfer film 104 is peeled off a transfer position of the transfer drum that is opposite to the photosensitive drum. Consequently, both the interior and exterior surfaces of the transfer film 104 are charged after the completion of the image forming processes.

The previously described conventional technique has many drawbacks. Specifically, a photosensitive material layer of the photosensitive drum is subjected to memory degradation if the electrostatically charged transfer film 104 of the transfer drum 100 is stopped while it is in contact with the photosensitive drum after the completion of the image forming processes (Unexamined Japanese Patent Application No. Hei-5-61368).

It is considered that the memory degradation of the photosensitive material layer of the photosensitive drum occurs when the toner images formed on the photosensitive drum are transferred to the transfer material. That is, the interior surface of the transfer film 104 is electrostatically charged by the transfer corotron. In contrast, when the transfer film 104 is peeled off the transfer position of the photosensitive drum, the exterior surface of the transfer film 104 is charged with the polarity opposite to that of the interior surface. The electric potential of the electrostatic charge of the transfer film 104 developed when the transfer drum 100 is stopped reaches up to 0–1200V depending on the number of transfer processes carried out by the transfer corotron. If the transfer film 104 of the transfer drum 100 is stopped while it is electrostatically charged, and in contact with the photosensitive drum, an electric field acts on the photosensitive material layer of the photosensitive drum (that is in contact with the transfer film 104) by means of the transfer film 104 having both surfaces electrostatically charged with opposite polarities. As a result of the action of the electric field, traps for carriers which transport electric charges to a charge generated layer arise in the photosensitive material layer of the photosensitive drum. As shown in FIG. 25, the carriers may be organic photoconductors (OPC). For this reason, development contrast of the area of the photosensitive layer on which the electric field acts becomes wider, thereby resulting in an electrostatic hysteresis phenomenon (i.e., the memory degradation) of the photosensitive material layer. For these reasons, the area of the photosensitive material layer of the photosensitive drum that is in contact with the transfer film 104 is different from the remaining area in development characteristics.

When an electrostatic latent image is formed on the photosensitive material layer, and when the thus-formed latent image is developed, stripes which are different from the other areas in density appear in a developed image. This occurs because the area of the photosensitive material that is in contact with the transfer film 104 is different from the other area in the development characteristics. Thus, a picture quality problem arises.

Both surfaces of the transfer film 104 of the transfer drum 100 are usually subjected to charge-removing operations by a pair of charge-removing corotrons. This occurs before the transfer drum 100 is stopped after the completion of the image forming apparatus. This process reduces the amount of charge. Depending on the pair of charge-removing corotrons, an imbalance related to the amount of electrostatic charge between the front and back surfaces of the transfer film 104 arises. This imbalance makes it difficult to completely remove the charges from both surfaces of the transfer film 104. Therefore, the electrostatic hysteresis phenomenon of the photosensitive layer cannot be effectively prevented.

The technique disclosed in Unexamined Japanese Patent Application No. Hei-5-61368 has already been proposed to solve the electrostatic hysteresis phenomenon of the photosensitive material layer of the photosensitive drum. An image forming apparatus disclosed in Unexamined Japanese Patent Application No. Hei-5-61368 comprises an image holding member on which a visible image is formed. The holding member also comprises a sheet-like transfer material holding member that has an overlap section for connecting the front and rear edges. The sheet-like transfer material holding member is movable while remaining in contact with the image holding member. The visible image of the image holding member is transferred onto a transfer material which is retained and transported by the transfer material holding member. The image forming apparatus comprises a detection member for detecting the shifted position of the transfer material holding member. The transfer material holding member stops on the basis of the signal received from the detection member. At time of stopping, the overlap section of the transfer material holding member is situated downstream in the direction of movement of the transfer material holding member with respect to the position where the transfer material holding member comes into contact with the image holding member. As a result, the electrostatically charged sheet-like transfer material holding member is prevented from contacting the image holding member. This prevents electrostatic hysteresis from arising in the photosensitive material layer.

In the case of the image forming apparatus disclosed in Unexamined Japanese Patent Application No. Hei-5-61368, if the sheet-like transfer material holding member becomes deformed as a result of heat expansion (due to several variables), the sheet-like transfer material holding member may come into contact with the photosensitive drum. This happens even if it is stopped at a specific position. Therefore, it is impossible to ensure prevention of the electrostatic hysteresis phenomenon of the photosensitive drum.

To ensure the prevention of the electrostatic hysteresis phenomenon of the sheet-like transfer material holding member due to variations in ambient conditions (such as a temperature or a humidity), it is also conceivable that the sheet-like transfer material holding member of the transfer drum is stopped while remaining separated away from the surface of the photosensitive drum by use of a retracting mechanism for separating the transfer drum from the photosensitive drum. However, the construction of the image forming apparatus is complicated, which adds to the costs.

SUMMARY OF THE INVENTION

The present invention solves the above drawbacks in the art. An object of the present invention is to provide an image forming apparatus capable of ensuring prevention of the electrostatic hysteresis phenomenon of the photosensitive material layer without increasing costs and/or complicating the construction of the image forming apparatus. This prevention is ensured even if there are changes in ambient conditions, such as a temperature or a humidity.

According to a first aspect of the present invention, an image forming apparatus which forms an image by transferring a developed image formed on an image holding member onto a transfer material by means of transfer means is provided. The improvement to the apparatus comprises induced-charge density suppressing means. The induced-charge density suppressing means suppresses the density of electric charge induced in the area of the image holding member (which is opposite to an image forming member) as a result of stoppage of the image forming member (that is opposite to the image holding member and is electrostatically charged).

According to a second aspect of the present invention an image forming apparatus which forms an image by forming a plurality of toner images having different colors on an image holding member one over another is provided. This second aspect further includes transferring the toner images formed on the image holding member onto a transfer material retained on a transfer material holding member while the toner images are retained in a stacked state by means of electrostatic charge of transfer means disposed in the transfer material holding member.

An improvement to the second aspect of comprises induced-charge density suppressing means for suppressing the density of electric charge induced in the area of the image holding member which is opposite to the transfer material holding member as a result of stoppage of the transfer material holding member which is opposite to the image holding member and is electrostatically charged.

According to a third aspect of the present invention, the image forming apparatus of the second aspect of the invention is further characterized by the induced-charge density suppressing means comprising a charge-removing means. The charge-removing means removes electric charges from one surface of the transfer material holding member after the completion of image forming processes.

According to a fourth aspect of the present invention, the image forming apparatus of the third aspect of the invention is further characterized by the charge-removing means comprising a charge-removing corotron. The charge-removing corotron is positioned so as to peel the transfer material from the transfer material holding member and receives an applied a.c. voltage.

According to a fifth aspect of the present invention, the image forming apparatus of the second aspect of the invention is further characterized by the induced-charge density suppressing means comprising retracting means. The retracting means separates a pressing member for pressing the transfer material holding member against the surface of the image holding member away from the image holding member when the image forming apparatus is in a suspended condition.

According to a sixth aspect of the present invention, the image forming apparatus of the second aspect of the invention is further characterized by the induced-charge density suppressing means comprising a stop position changing means. The stop position charging means changes the area of the transfer material holding member (that is opposite to the image holding member) when the transfer material holding member is stopped. This is performed on the basis of detected results, such as temperature and humidity.

According to a seventh aspect of the present invention, the image forming apparatus of the second aspect of the invention is further characterized by the induced-charge density suppressing means comprising an electric charge prohibiting means. The electric charge prohibiting means prohibits the transfer means from electrically charging the area of the transfer material holding means when the transfer material holding means is stopped.

According to an eighth aspect of the present invention, the image forming apparatus of the seventh aspect of the invention is characterized by the transfer means comprising a corotron for transfer charging purposes.

According to a ninth aspect of the present invention, the image forming apparatus of the seventh aspect of the invention is further characterized by the transfer means comprising either a conductive brush or a conductive roller.

According to a tenth aspect of the present invention, the image forming apparatus of the seventh aspect of the invention is further characterized by the transfer means comprising an intermediate roller having a resistance layer provided on the front side and a conductive layer provided on the back side. Additionally, the toner images are transferred by application of a bias voltage to the conductive layer of the intermediate transfer roller.

According to an eleventh aspect of the present invention, the image forming apparatus of the first aspect of the invention is further characterized by the image forming member comprising a cleaning blade. The image forming member is provided with induced-charge density suppressing means for suppressing the density of electric charge induced in the area of the image holding member which is opposite to the cleaning blade.

According to a twelfth aspect of the present invention, the image forming apparatus of the eleventh aspect of the invention is further characterized by the induced-charge density suppressing means, which is opposite to the cleaning blade, comprising a removing means. The removing means removes the toner deposited on the cleaning blade.

According to a thirteenth aspect of the present invention, an image forming apparatus which forms an image by forming a plurality of toner images having different colors on an image holding member one over another, and transferring the toner images formed on the image holding member onto a transfer material or an intermediate transfer member retained on a transfer material holding member while the toner images are retained in a stacked state is provided. The improvement to the apparatus comprises induced-charge density suppressing means. The induced-charge density suppressing means suppressing the density of electric charge induced in the area of the image holding member which is opposite to the transfer material holding member or the intermediate transfer member as a result of stoppage of the transfer material holding member or the intermediate transfer member which is opposite to the image holding member and is electrostatically charged. The apparatus further comprises induced-charge density suppressing means that is made up of separation means for separating the transfer material holding member or the intermediate transfer member away from the image holding member when the image forming apparatus is suspended.

According to a fourteenth aspect of the present invention, the image forming apparatus of the first or second aspect of the invention is characterized by the induced-charge density suppressing means is arranged so as to suppress the density of electric charge induced in the image holding member to $-2.7\times10^{-14}$–$5.0\times10^{-14}$ C/m$^2$.

According to a fifteenth aspect of the present invention, an image forming apparatus which forms an image by forming a plurality of toner images having different colors on an image holding member one over another, and transferring the toner images formed on the image holding member onto a transfer material retained on a transfer material holding member while the toner images are retained in a stacked state, the improvement comprising the transfer material holding member which is provided with a drum-shaped frame. The drum-shaped frame is made up of a pair of annular members disposed on both longitudinal ends of the drum-shaped frame, and a joint member for connecting the annular members to each other. A transfer film is wrapped around the drum-shaped frame. The area of the transfer material holding member that is opposite to the image holding member when the transfer material holding member is stopped is set so that the joint member of the transfer material holding member is positioned in an upstream direction in the direction of the movement of the transfer material holding member with respect to the line between the centers of the image holding member and the transfer material holding member.

The image forming apparatus of the first aspect of the present invention reliably prevents the electrostatic hysteresis phenomenon. By virtue of the suppression of the density of electric charge induced in the area of the image holding member which is opposite to the image forming member by means of the induced-charge density suppressing means it becomes possible to reliably prevent the electrostatic hysteresis phenomenon that results from the induction of electric charges in the image holding member without increasing costs or complicating the construction.

The image forming apparatus of the second aspect of the present invention also reliably prevents electrostatic hysteresis phenomenon. By virtue of the suppression of the density of electric charge induced in the area of the image holding member which is opposite to the transfer material holding member by means of the induced-charge density suppressing means, it becomes possible to reliably prevent the electrostatic hysteresis phenomenon resulting from the induction of electric charges in the transfer material holding member without increasing costs or complicating the construction of the image forming apparatus.

The image forming apparatus according to the third aspect of the present invention, the induced-charge density suppressing means also prevents electrostatic hysteresis phenomenon. As a result, it is possible to reliably prevent the electrostatic hysteresis phenomenon of the image holding member by use of a simple structure. That is, the charge-removing means.

In the image forming apparatus according to the fourth aspect of the present invention, the charge-removing means reliably prevents the electrostatic hysteresis of the image holding member without addition of any new members by use of the conventional charge-removing corotron. Therefore, the complication of the construction of the image forming apparatus and an increase in costs are prevented.

In the image forming apparatus according to the fifth aspect of the present invention reliably prevents the electrostatic hysteresis phenomenon of the image holding member by means of the simple structure. That is, the retracting means for separating the pressing member away from the image holding member.

Referring to the sixth aspect of the present invention, and acknowledged by the inventors of the present invention through experimention, the occurrence of the electrostatic hysteresis is dependent on ambient conditions such as a temperature or a humidity as well as the area of the transfer material holding member that is opposite to the image holding member when the transfer material holding member is stopped. For this reason, if the area of the transfer material holding member is changed on the basis of at least one of the detected results (temperature and a humidity), it is possible to reliably prevent the electrostatic phenomenon without complicating the construction of the image forming apparatus or increasing costs.

In the forming apparatus according to the seventh aspect of the present invention, the transfer means is prevented from electrostatically charging the area of the transfer material holding means. Thus, the amount of electrostatic charge induced in the area of the transfer material holding member that is opposite to the image holding member can be reduced. As a result, it is possible to reliably prevent the electrostatic hysteresis phenomenon of the image holding member without addition of any new members.

In the image forming apparatus according to the eleventh aspect of the present invention, the image forming member that is opposite to the image holding member and is electrostatically charge is a cleaning blade. The image forming member is provided with the induced-charge density suppressing means for suppressing the density of electric charge induced in the area of the image holding member which is opposite to the cleaning blade. Even if the image forming member is different from the transfer material holding member, the present invention can be applied to cases where an electrostatic hysteresis phenomenon may arise in the image forming apparatus.

In the image forming apparatus according to the twelfth aspect of the present invention, the induced-charge density suppressing means for suppressing the density of electric charge induced in the area of the image holding member reliably prevents the electrostatic hysteresis phenomenon that results from the deposition of the charge toner on the cleaning blade. The image forming apparatus according to the thirteenth aspect of the present invention also reliably prevents electrostatic hysteresis phenomenon.

In the image forming apparatus according to the fourteenth aspect of the present invention, it is also possible to reliably prevent electrostatichysteresis phenomenon. As is evident from the experiments carried out by the inventors of the invention, it is possible to reliably prevent the electrostatic hysteresis phenomenon even if the ambient conditions change because the transfer member is arranged so as to suppress the density of electric charge-induced in the image holding member to $-2.7\times10^{-14}$–$5.0\times10^{-14}$ C/m$^2$.

In the image forming apparatus according to the fifteenth aspect of the present invention, the transfer material holding member is provided with a drum-shaped frame which is made up of a pair of annular members disposed on both longitudinal ends of the drum-shaped frame, and a joint member for connecting the annular members to each other. A transfer film is wrapped around the drum-shaped frame. The area of the transfer material holding member that is opposite to the image holding member, when the transfer material holding member is stopped, is set so that the joint member of the transfer material holding member is positioned in an upstream direction in the direction of the movement of the transfer material holding member with respect to the line between the centers of the image holding member and the transfer material holding member. As a result of the shift of the transfer material holding member, the density of electric charge induced in the area of the image holding member that is opposite to the transfer material holding member can be suppressed. Further, the area of the transfer material holding member that is opposite to the image holding member when the transfer material holding member is stopped, is set such that the joint member of the transfer material holding member is positioned in an upstream direction in the direction of the movement of the transfer material holding member with respect to the line between the centers of the image holding member and the transfer material holding member. As a result, the image forming of a first transfer material can be started early. This makes it possible to improve the productivity of the image forming operation.

The above and other objects and features of the present invention will be more apparent from the following description taken in conjunction with the accompanying drawings.

DETAILED DESCRIPTION OF PREFERRED EMBODIMENTS

First Embodiment

Figure 2:
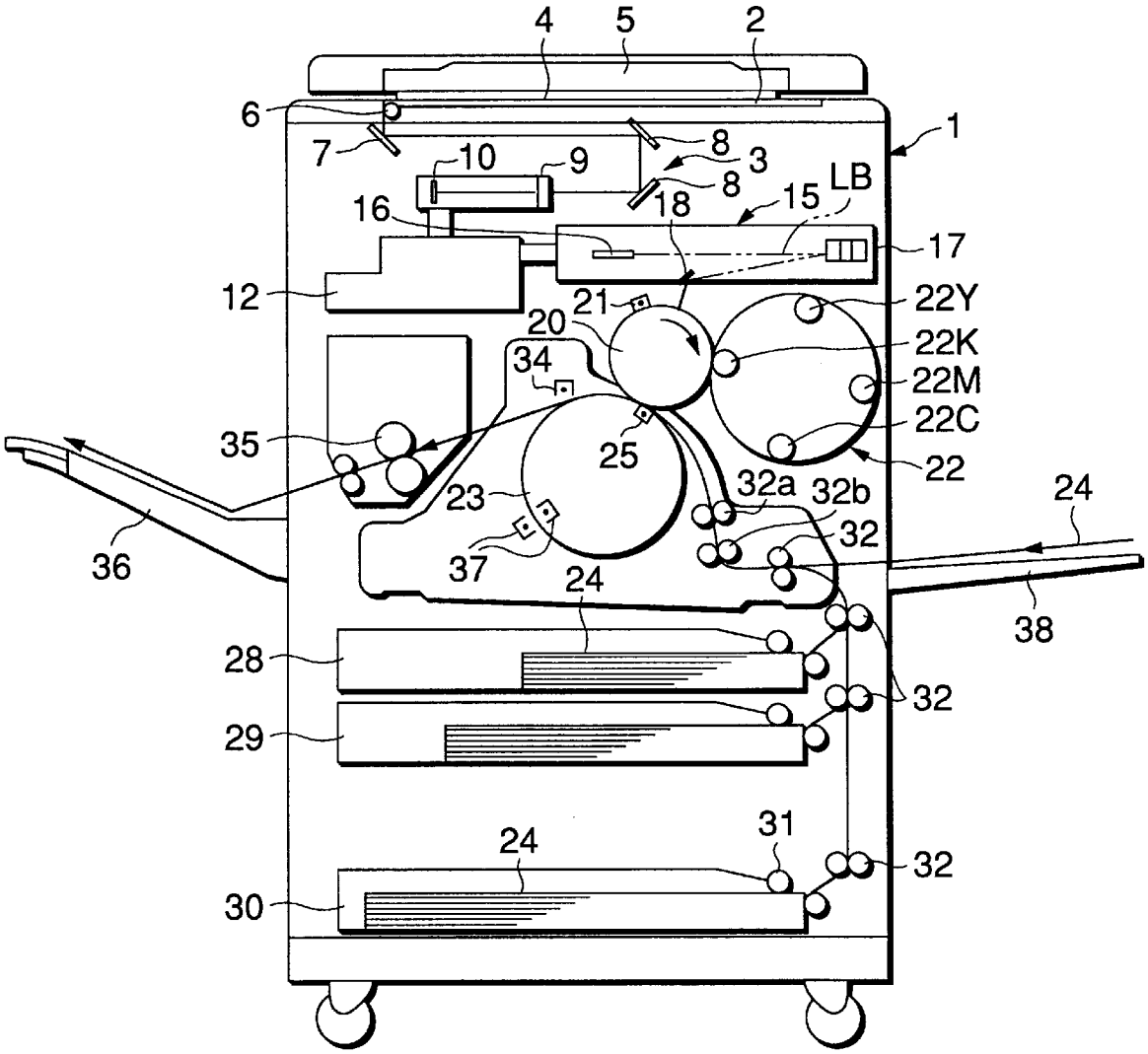
FIG. 2 is a schematic representation showing the digital color image forming apparatus that is one embodiment of the image forming apparatus according to the present invention.

FIG. 2 shows a multiple-transfer digital color image forming apparatus. FIG. 2 shows a main body 1 of the digital color image forming apparatus. An image reader 3 (Image Input Terminal) for reading an original 2 is placed on the upper end of the digital color image forming apparatus 1. The image reader 3 illuminates an image of the original 2 using a light source 6. The original 2 is placed on a platen glass 4 while it is pressed by a platen cover 5. A CCD sensor 10 is exposed to an image of light reflected from the original 2 through first scan mirror 7, second scan mirror 8 and an image forming lens 9, in a scanning manner. The CCD sensor 10 reads the image of the light reflected from a color material of the original 2 using the CCD sensor 10 at a predetermined dot density (e.g., a density of 16 bits/mm).

The image of the light reflected from the color material of the original 2 read by the image reader 3 is sent to an image processor 12 (Image Processing System) as reflecting power data of the original for three colors Red (R), Green (G), and Blue (B) (data for each color comprising 8 bits). In the image processor 12 the reflecting power data of the original 2 are subjected to predetermined image processing such as shading correction, misregistration correction, lightness/color space conversion, gamma control, frame erasing operations, and color/move edition operations.

The image data subjected to the predetermined image processing in the image processor 12 are converted into original color material gradation data for four colors Black (K), Yellow (Y), Magenta (M), and Cyan (C) (the data of each color comprises 8 bits). The thus-converted data are then sent to an ROS 15 (Raster Output Scanner), and the ROS 15 exposes images to a laser beam LB corresponding to the original color material gradation data.

As shown in FIG. 2 the ROS 15 modulates the semiconductor laser 16 according to the original color material gradation data 14. The semiconductor laser 16 emits the laser beam LB according to the original color material gradation data 14. The laser beam LB emitted from the semiconductor laser 16 is deflected into a scan beam by a rotary polygon mirror 17. A photosensitive drum 20 is exposed to this scan beam in a scanning manner via a reflection mirror 18.

The photosensitive drum 20 is rotated at a predetermined speed in the direction designated by an arrow by means of drive means (not shown). The surface of the photosensitive drum 20 is previously electrostatically charged to a predetermined electric potential by an electrostatically charging corotron 21. Then, the thus-charged surface of the photosensitive drum 20 is exposed to the laser beam LB in a scanning manner, whereby electrostatic latent images are formed. The electrostatic latent images formed on the photosensitive drum 20 are developed one after another by a rotary developing apparatus 22 that has developing units for four colors, Black (K), Yellow (Y), Magenta (M), and Cyan (C) (e.g., developing units 22K, 22Y, 22M, and 22C). As a result, toner images having predetermined colors appear.

The toner images formed on the photosensitive drum 20 are transferred onto a transfer material, i.e., transfer paper 24, and retained on a transfer drum 23 disposed adjacent to the photosensitive drum 20 by means of electrostatic charge of a transfer corotron 25. The transfer material 24 is fed from a plurality of paper feed cassettes 28, 29, and 30 disposed in a lower part of the image forming apparatus main body 1 by means of a paper feed roller 31. The transfer material 24 can be also fed from a manual paper feed tray 38 attached to the exterior side surface of the image forming apparatus main body 1. The thus-fed transfer material 24 is transported to the surface of the transfer drum 23 by means of a transfer roller 32 and resist rollers 32*a* and 32*b*. The transfer material 24 is retained on the surface of the transfer drum 23 while being electrostatically adsorbed on the surface of the transfer drum 23 by means of electrostatic charge of a transfer corotron 25 that doubles as a corotron for adsorbing purposes.

It is also possible to feed a transparent OHP sheet for over-head projection purposes or thick paper such as special post cards (other than transfer paper) having a nonstandard size from the manual feed tray 38. As a result, images can be formed on the OHP sheet. Further, if the transfer material 24 having an image formed on one side is fed from the manual feed tray 38 while it is turned inside out, both sides of the transfer material can be printed.

The transfer material 24 on which the toner images of a predetermined number of colors have been transferred from the photosensitive drum 20 is peeled off the surface of the transfer drum 23 by the electrostatic charge of a detaching corotron 34. The thus-peeled transfer material 24 is carried to a fixing unit 35. The toner images are fixed on the transfer material 24 by heat and pressure with the fixing unit 35. The transfer material 24 is then discharged to a paper discharge tray 36, whereby the color image forming processes are now completed. FIG. 2 also shows a pair of charge-removing corotrons 37 for removing electrostatic charges from both surfaces of the transfer drum 23.

Figure 3:
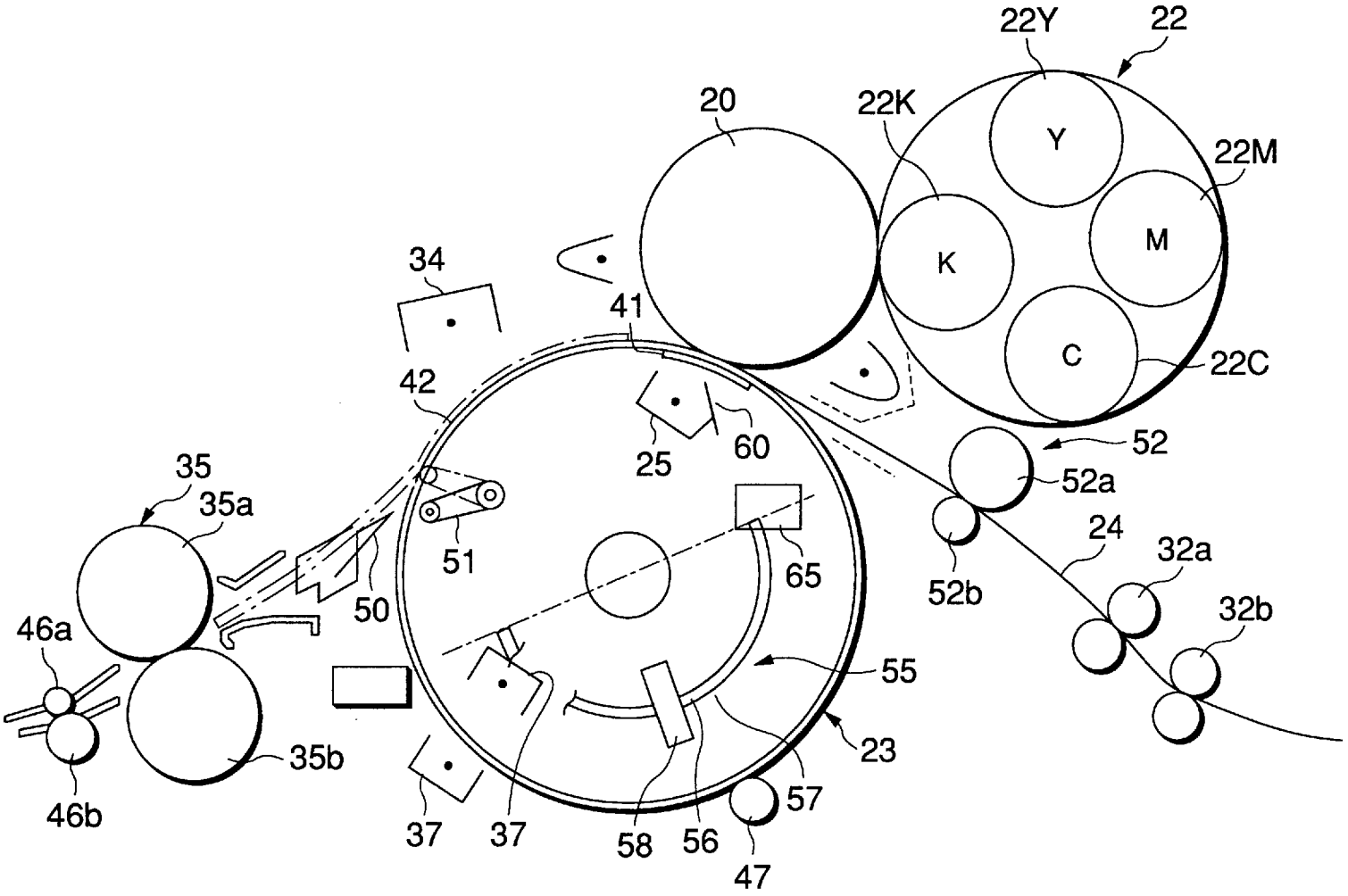
FIG. 3 is a schematic representation showing the principle elements of the digital color image forming apparatus that is one embodiment of the image forming apparatus according to the present invention.
Figure 4:
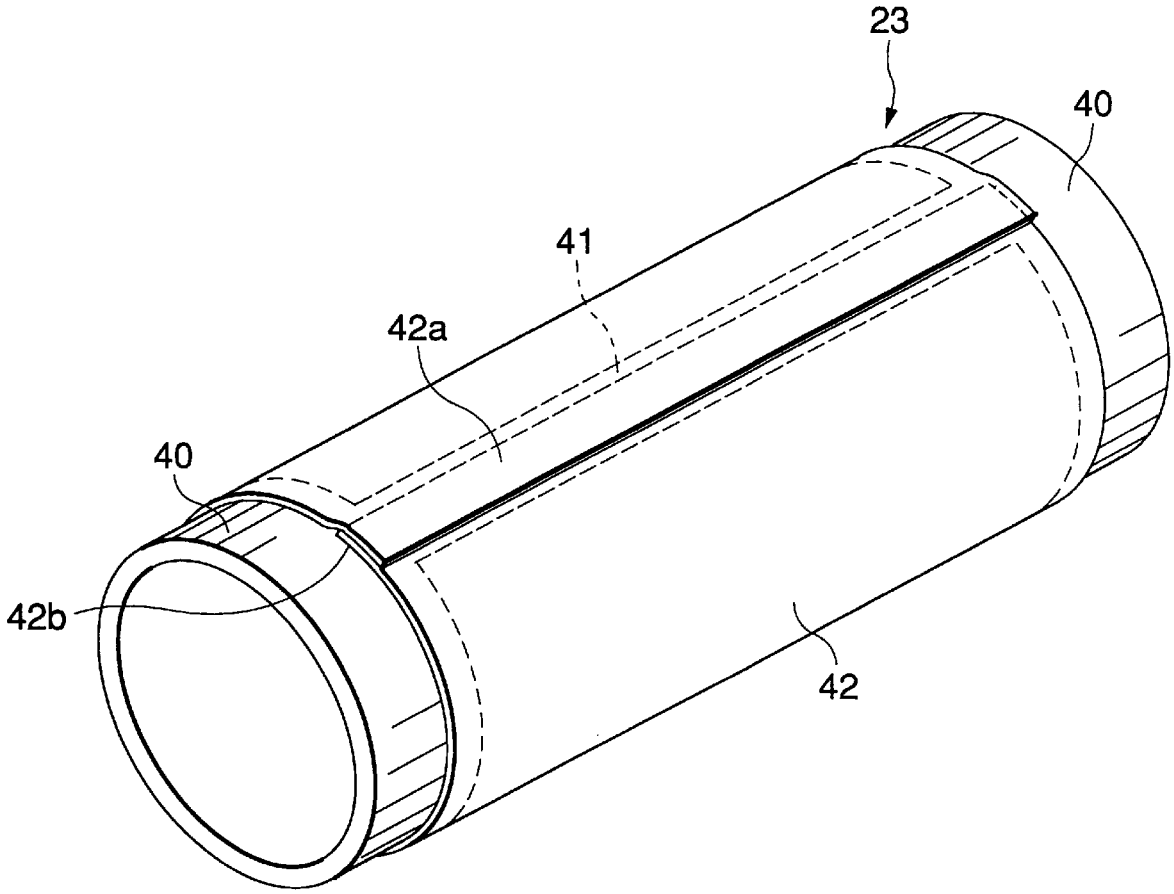
FIG. 4 is a perspective external view of a transfer drum.

FIG. 3 shows the above-described photosensitive drum 20. The photosensitive drum 20 is rotated at a predetermined speed in the direction designated by an arrow by means of drive means (not shown). A photosensitive drum on the surface of which a photosensitive material layer is formed (made of an organic photoconductor (OPC)). The photosensitive material layer is used as the photosensitive drum 20. In the transfer position of the photosensitive drum 20, the transfer drum 23 that acts as a transfer material holding member is disposed in close proximity to the photosensitive drum 20 in a noncontact manner with a clearance close to the thickness of the transfer material 24 (about 90 to 100 $\mu$m) between the surface of the photosensitive drum 20 and the transfer drum 23. The transfer drum 23 is rotated at a speed which is the same as the peripheral speed of the photosensitive drum 20 by means of a drive mechanism (not shown). The transfer drum 23 has a drum-shaped frame. The drum-shaped frame comprises a pair of ring members 40 which act as annular members. The ring members 40 are disposed on both longitudinal ends of the transfer drum 23. A tie-bar plate 41 for connecting the ring members 40 to each other are shown in FIG. 4.

Figures 5, 6:
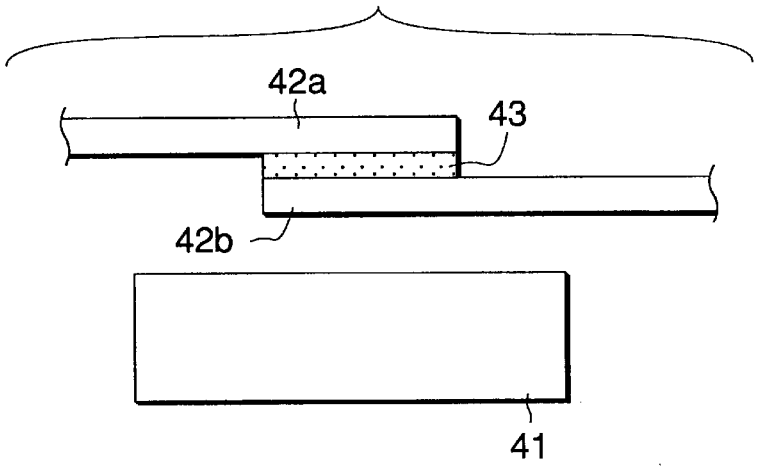
FIG. 5 is a cross-sectional view of the principle elements of the transfer drum.
FIG. 6 is a table showing the occurrence of strips due to electrostatic hysteresis developed in a photosensitive material layer.

A transfer film 42, which is made of a dielectric film such as a polyvinylidene fluoride (PVdF) and has a thickness of 150 $\mu$m. The transfer film 42 is wrapped around and bonded to the drum-shaped frame with an adhesive, such as a pressure sensitive adhesive double coated tape, while both longitudinal side edges of the transfer film 42 are aligned with the outer peripheries of the ring members 40. In this condition, a circumferential front edge 42*a* and a circumferential rear edge 42*b* of the transfer film 42 are bonded to each other by means of a pressure sensitive adhesive double coated tape 43 in an overlapped manner as seen in FIG. 5.

As a result, the transfer drum 23 is formed into a hollow cylinder. In this event, the toner images formed on the photosensitive drum 20 cannot be properly transferred onto the bonded portion of the transfer film 42. For this reason, the bonded portion of the transfer film 42 is set so as to be positioned in an non-image area of the transfer drum 23, i.e., the tie-bar plate 41, with a clearance between the bonded portion and the tie-bar plate 41.

As previously described, the transfer material 24 is fed to the transfer drum 23 from any one of the plurality of paper feed cassettes 28, 29, and 30. This transfer material 24 is transported to the transfer position of the transfer drum 23 at predetermined timing by the resist rollers 32*a* and 32*b*. The transfer material 24 is subjected to the electrostatic charge generated by the corotron 25 for transfer purposes from the back side of the transfer drum 23. As a result, the transfer material 24 is electrostatically adsorbed on the transfer film 42 of the transfer drum 23. The toner images of Black (K), Yellow (Y), Magenta (M), and Cyan (C) are formed one after another on the photosensitive drum 20 by means of the electrostatic charge of the transfer corotron 25.

The detaching corotron 34 removes charges from the transfer material 24 on which a predetermined number of toner images have been transferred from the photosensitive drum 20. The transfer material 24 is deformed by a finger 50 and an inner pressing roller 51 of a peeling unit 44, whereby the transfer material 24 is peeled from the surface of the transfer drum 23. The thus-peeled transfer material 24 is transported to a fixing unit 35 via a transport guide 45. The toner images are fixed on the transfer material 24 by heat and pressure of fixing rollers 35*a* and pressing rollers 35*b* of the fixing unit 35. The transfer material 24 is then discharged to a discharge tray 36 outside the image forming apparatus by a fuser exit roller 46.

As shown in FIG. 3 a curling roller 52 which facilitates the wrapping of the relatively thick transfer material 24 around the transfer film 42 is disposed downstream of the resist rollers 32*a* so as to make it possible to form an image on the relatively thick transfer material 24, such as a post card. The curling roller 52 is made up of an elastic roller 52*a* that faces the front surface of the transfer material 24 and has a large diameter. The curling roller 52 also has a metal roller 52*b* that faces the back surface of the transfer material 24 and has a small diameter. The curling roller 52 does not need to give curl to ordinary transfer paper. The elastic roller 52*a* and the metal roller 52*b* are retractable so as to be separated from each other.

In this embodiment, a straightening roller is used for the fuser exit roller 46 in order to straighten the transfer material 24 that has been fixed and curled through the passage of the fixing unit 35. The straightening roller 46 is made up of a roller 46*a* that has a small diameter and faces the front side of the transfer material 24. The straightening roller 46 also has a roller 46*b* that has a large diameter and faces the back of the transfer material 24.

Figure 1:
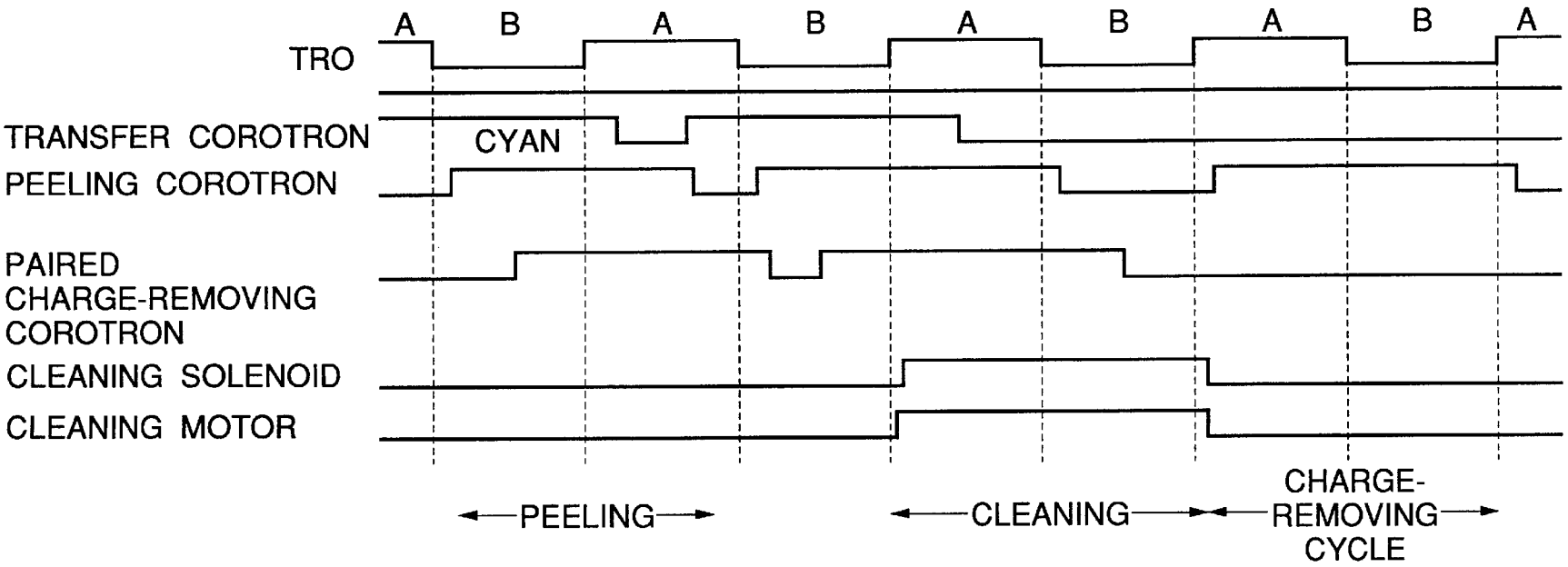
FIG. 1 is a timing chart showing the operation of a digital color image forming apparatus that is one embodiment of an image forming apparatus according to the present invention.

In the digital color image forming apparatus having the above-described construction, a reference signal generator 55 is disposed in the transfer drum 23. The reference signal generator 55 generates a reference signal for dividing the circumferential surface of the transfer drum 23 into two areas, as shown in FIG. 3. The reference signal generator 55 is assembled together with the transfer drum 23 into a single unit. The reference signal generator 55 comprises a slit plate 57 that has a crescent slit 56 which rotates together with the transfer drum 23. The reference signal generator 55 also comprises an optical sensor 58 that optically detects the slit 56 and generates a reference signal. As shown in FIG. 1 the reference signal generator 55 outputs a reference signal (TRO signal) which becomes a high or a low each time the transfer drum 23 rotates half (through an angle of 180 degrees).

In FIG. 3 a cleaning brush 47 for cleaning the surface of the transfer drum 23 is shown. The cleaning brush 47 is usually separated from the surface of the transfer drum 23 but comes into contact with the surface of the transfer drum 23 at predetermined times so that the surface of the transfer drum 23 is cleaned. The digital color image forming apparatus of this embodiment is provided with induced-charge density suppressing means for suppressing the density of electric charge induced in the area of the image holding member which is opposite to the image forming member as a result of stoppage of the image forming member that is opposite to the image holding member and is electrostatically charged.

The inventors of the present invention prototyped the digital color image forming apparatus, as shown in FIGS. 2 and 3. The inventors then performed tests to determine the occurrence of electrostatic hysteresis phenomenon in the photosensitive material layer of the photosensitive drum 20. The tests were based on the assumption that the photosensitive drum 20 and the transfer drum 23 are stopped after the completion of the color image forming processes without use of the induced-charge density suppressing means. The following conditions were used in the test:

1) the position where the transfer drum 23 is stopped so as to be opposite to the photosensitive drum 20 is set on the tie-bar plate 41 of the transfer drum 23;
2) the position is set to the transfer film 42 other than the tie-bar plate 41;
3) a high temperature and a high humidity (e.g., a temperature of 28 centigrades, and a humidity of more than 85%); and
4) a low temperature and a low humidity (e.g., a temperature of 10 centigrades and a humidity of less than 30%).

An a.c. voltage having an RMS of 5.0 KV was applied to the detaching corotron 34. An a.c. voltage having an RMS of 4.0 KV and a d.c. voltage of 11V were applied to an outer one of the pair of corotrons 37 while they were superimposed one on another. Only an a.c. voltage having an RMS of 4.4 KV was applied to an inner one of the corotrons 37.

FIG. 6 shows the results of the above-described tests. As is evident from FIG. 6, no electrostatic hysteresis phenomenon developed in the photosensitive material layer of the photosensitive drum 20 when the transfer drum 23 was stopped on the tie-bar plate 42 at a low temperature and a low humidity. In contrast, the electrostatic hysteresis phenomenon developed in the photosensitive material layer when the transfer drum 23 was stopped on the transfer film 42 other than the tie-bar plate 41 at a lower temperature and a low humidity. No electrostatic hysteresis phenomenon developed in the photosensitive material layer when the transfer drum 23 was stopped on the transfer film 42 other than the tie-bar plate 41 at a high temperature and a high humidity. Contrary to this, the electrostatic hysteresis phenomenon developed in the photosensitive material layer when the transfer drum 23 was stopped on the tie-bar plate 41 at a high temperature and a high humidity.

The fact that the occurrence of the electrostatic hysteresis phenomenon in the photosensitive material layer of the photosensitive drum 20 was indefinite before the induced-charge density suppressing means was used in the digital color image forming apparatus is deemed to be attributable to several reasons. The reason why no electrostatic hysteresis phenomenon developed in the photosensitive material layer when the transfer drum 23 was stopped on the tie-bar plate 41 at a low temperature and a low humidity is that the transfer material 24 was not originally present on the tie-bar plate 41 of the transfer drum 23. In other words, the transfer corotron 25 is usually arranged so as not to operate when the tie-bar plate 41 of the transfer drum 23 passes the transfer position. As a result, the area of the transfer drum 23 corresponding to the tie-bar plate 41 is not electrostatically charged by the transfer corotron 25. For this reason, if the transfer drum 23 is stopped on the tie-bar plate 41, it is considered that the electric field does not act on, or very weakly acts on, the photosensitive material layer of the photosensitive drum 20. This prevents the electrostatic hysteresis phenomenon from developing in the photosensitive material layer. In contrast, if the transfer drum 23 is stopped on the transfer film 42 at a low temperature and a low humidity, the electrostatic hysteresis phenomenon develops in the photosensitive material layer. This is because the transfer film 42 of the transfer drum 23 is electrostatically charged by the transfer corotron 25 in order to transfer the toner images formed on the photosensitive drum 20 to the transfer film. Specifically, the electrostatically charged voltage reaches up to 0 to 1200 V at the end of the image forming processes. These electrostatic charges cannot be fully removed by ordinary charge-removing operations, as a result of which the transfer film 42 remains electrostatically charged. The transfer film 42 has high resistance at a low temperature and a low humidity, and hence it is considered that the electric charges are not freed and remain in the transfer film 42.

In contrast, the reason why no electrostatic hysteresis developed in the photosensitive material layer when the transfer drum 23 was stopped on the transfer film 42 at a high temperature and a high humidity is deemed to be attributable to the fact that the resistance of the transfer film 42 has relatively dropped at a high temperature and a high humidity. On the other hand, the reason why the electrostatic hysteresis developed in the photosensitive material layer when the transfer drum 23 was stopped on the tie-bar plate 41 at a high temperature and a high humidity is deemed to be attributable to the fact that the area of the transfer drum 23 corresponding the tie-bar plate 41 was not electrostatically charged by the transfer corotron 25 in the manner as previously described. However, the resistance of the transfer film 42 relatively dropped at the high temperature and the high humidity. As a result, it becomes easy for the electric charges to travel from the surface of the transfer film 42 and to concentrate on the edge of the same. This brings about the electrostatic hysteresis phenomenon in the photosensitive material layer.

Because of the above-described reasons, the occurrence of the electrostatic hysteresis phenomenon in the photosensitive material layer of the photosensitive drum 20 depends on the ambient conditions such as a temperature and a humidity and the position where the transfer drum 23 stops in the digital color image forming apparatus which does not employ the induced-charge density suppressing means. Therefore, the electrostatic hysteresis phenomenon developed in the photosensitive material layer of the photosensitive drum 20 is due to the amount of electric charge which the transfer film 42 of the transfer drum 23 receives while the transfer drum 23 is stopped so as to be opposite to the photosensitive drum 20.

The inventors of the present invention considered that the occurrence of the electrostatic hysteresis phenomenon of the photosensitive layer of the photosensitive drum is due to the intensity of the electric field that acts on the photosensitive material layer as a result of the transfer film of the transfer drum being electrically charged. In order to clarify the conditions under which the electrostatic hysteresis phenomenon develops in the photosensitive material layer, the inventors conducted the experiment for studying the relationship between the quantity of electric charge induced in the photosensitive layer and the occurrence of stripes caused by the electrostatic hysteresis phenomenon of the photosensitive material layer.

Figure 7A:
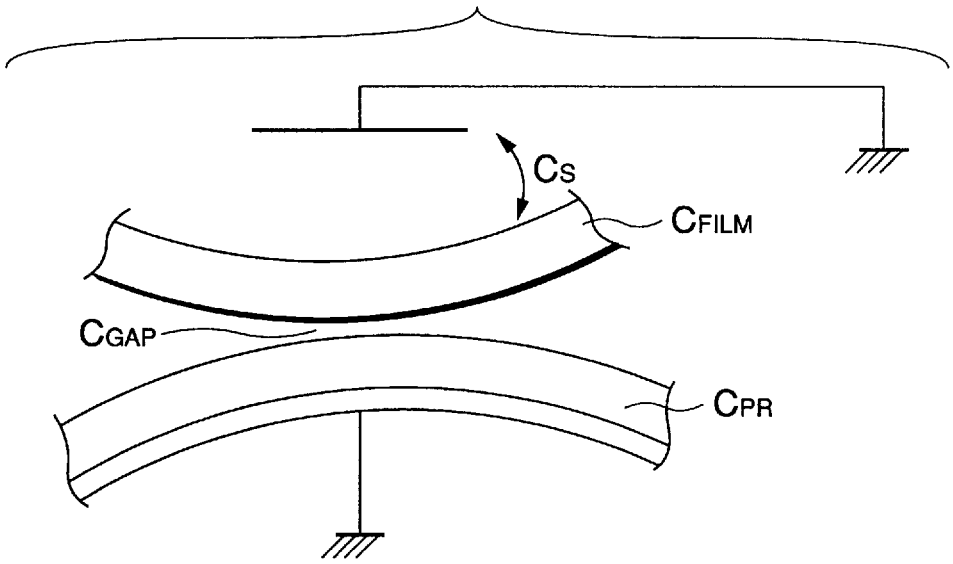
FIG. 7A is a diagrammatic representation showing a contact area between a photosensitive drum and a transfer drum.
Figure 7B:
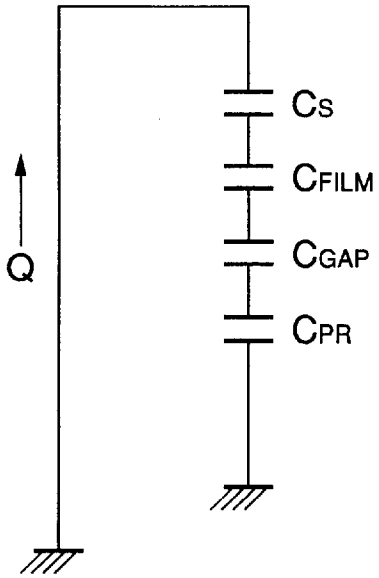
FIG. 7B is an equivalent circuit showing the contact area between the photosensitive drum and the transfer drum.

In this event, the quantity of electric charge induced in the photosensitive material layer was calculated by the expression which will be describe later. In other words, the condition in which the photosensitive material layer of the photosensitive drum 20 is stopped, while being opposite to the electrostatically charged transfer film 42 of the transfer drum 23, can be made analogous to a plurality of capacitors connected in series (FIG. 7). FIG. 7 shows $C_{PR}$, $C_{GAP}$, $C_{FILM}$, $C_S$. $C_{PR}$ designates a capacitance of the photosensitive material layer of the photosensitive drum 20. $C_{GAP}$ designates the capacitance of the layer of air between the photosensitive material layer of the photosensitive drum 20 and the transfer drum 23. $C_{FILM}$ designates the capacitance of the transfer film 42 of the transfer drum. $C_S$ designates the stray capacitance between the transfer film 42 of the transfer drum 23 and a grounded metallic member that is provided behind the transfer drum 23.

As is generally known, voltage V across a capacitor is given by dividing charge Q by capacitance C, i.e., v=Q/C. Further, capacitance C of a capacitor consisting of a pair of parallel plates is given by $C=\in\cdot S/d$, where $\in$ is the dielectric constant of the substance between the electrodes, S is the area of the electrodes, and "d" is the distance between the electrodes. Therefore, the voltage V across the capacitor can be expressed by $$V=(d\cdot Q)/(\in\cdot S)=(d\cdot\sigma)/\in,$$

where Q/S designates the density of electric charge, i.e., σ.

On the assumption that (i) the charge of the front side of the transfer film 42 of the transfer drum 23 (i.e., the surface facing the photosensitive drum 20) is $Q_2$, (ii) that the charge of the back surface of the transfer film 42 is $Q_1$, (iii) that only the charge $Q_2$ is exist on the front side of the transfer film 42, and (iv) that the charge induced in the capacitor by means of the charge $Q_2$ is $Q_{20}$, an expression is obtained. This expression is further based on the assumption that because the capacitor has both ends grounded the capacitance has a voltage of 0.

$$Q_2(1/CPR+1/C_{GAP})+Q_{20}(1/C_{PR}+1/C_{GAP}+1/C_{FILM}+1/C_S=0 \quad (1)$$

From equation (1), the charge $Q_{20}$ induced in the capacitor by means of the charge $Q_2$ is given by:

$$Q_{20}=-Q_2(D_{PR}+D_{GAP})//D_T \quad (2)$$

where $D_{PR}=1/C_{PR}$, $D_{GAP}=1/C_{GAP}$, $D_T=1/C_{PR}+1/C_{GAP}+1/C_{FILM}+1/C_S$.

If only the charge $Q_1$ exists on the back side of the transfer film 42 of the transfer drum 23, the following expression will be given on the assumption that the charge induced in each capacitor by the charge $Q_1$ is $Q_{10}$, (because the capacitor has both ends grounded).

$$Q_1(1/C_{PR}+1/C_{GAP}+1/C_{FILM})+Q_{10}(1/C_{PR}+1/C_{GAP}+1/C_{FILM}+1/C_s)=0 \quad (3)$$

From equation (3), the charge $Q_{10}$ induced in each capacitor by the charge $Q_1$ is given by:

$$Q_{10}=-Q_1(D_{PR}+D_{GAP}+D_{FILM})/D_T \quad (4)$$

where $D_{FILM}=1/C_{FILM}$.

As a result of the combination of equations (2) and (4), electric field $E_{GAP}$ acting on the clearance between the photosensitive drum 20 and the transfer drum 23 is given, on the basis of the assumption that $Q=Q_{10}+Q_{20}$, by:

$$E_{GAP}=Q/\epsilon_0=(1/\epsilon_0)\cdot\{Q_1+Q_2-Q_1(D_{PR}+D_{GAP}+D_{FILM})/D_T-Q_2(D_{PR}+D_{GAP})/D_T\}=(1/\epsilon_0)\cdot\{Q_1\cdot D_S/D_T+Q_2(D_S+D_{FILM})/D_T\}=(1/\epsilon_0)\cdot\{(D_S/D_T)(Q_1+Q_2)+(D_{FILM})/D_T)\}. \quad (5)$$

Figure 8:
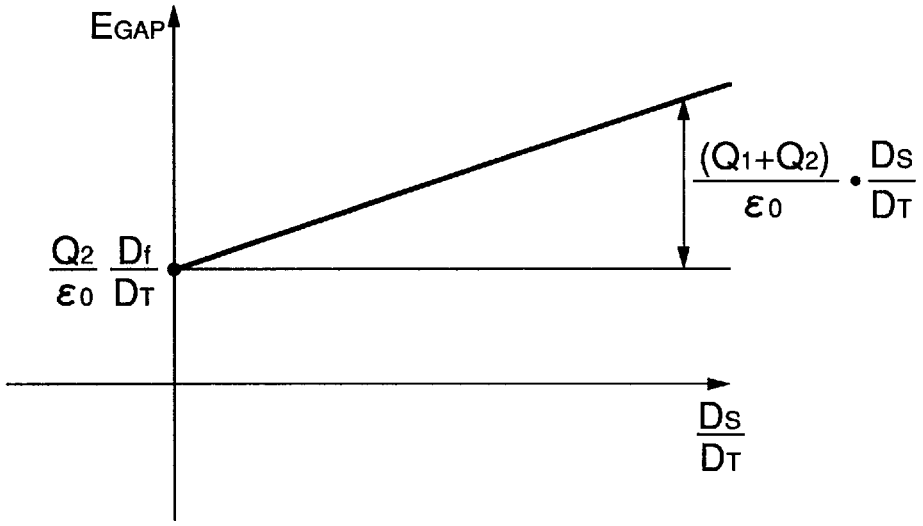
FIG. 8 is a graph showing the magnitude of an electric file that acts on the clearance between the photosensitive drum and the transfer drum.

FIG. 8 shows a plot in which the vertical axis is electric field $E_{GAP}$, and in which the horizontal axis is $D_S$. From the above descriptions, it can be seen that the electric field $E_{GAP}$ formed between the electrostatically charged transfer film 42 and the photosensitive material layer of the photosensitive drum 20 is dependent on the sum of the charges of both sides of the transfer film 42 ($Q_1+Q_2$) and the charge $Q_2$ of the front side of the transfer film 42. Therefore, the electric field acting on the photosensitive material layer of the photosensitive drum 20 is reduced so long as the charge $Q_2$ of the front side of the transfer film 42 is reduced as well as the sum of the charges of both sides of the transfer film 42, or ($Q_1+Q_2$), is reduced to nearly zero. The reduction of the electric field contributes to prevention of the electrostatic hysteresis phenomenon of the photosensitive layer.

Figure 9B:
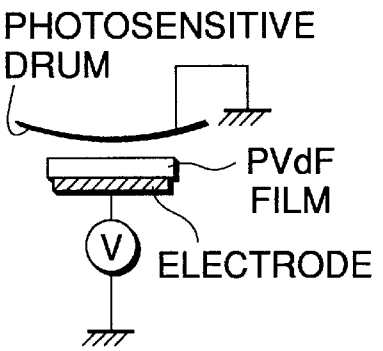
FIG. 9B is a diagrammatic representation showing conditions of experiments.
Figure 9A:
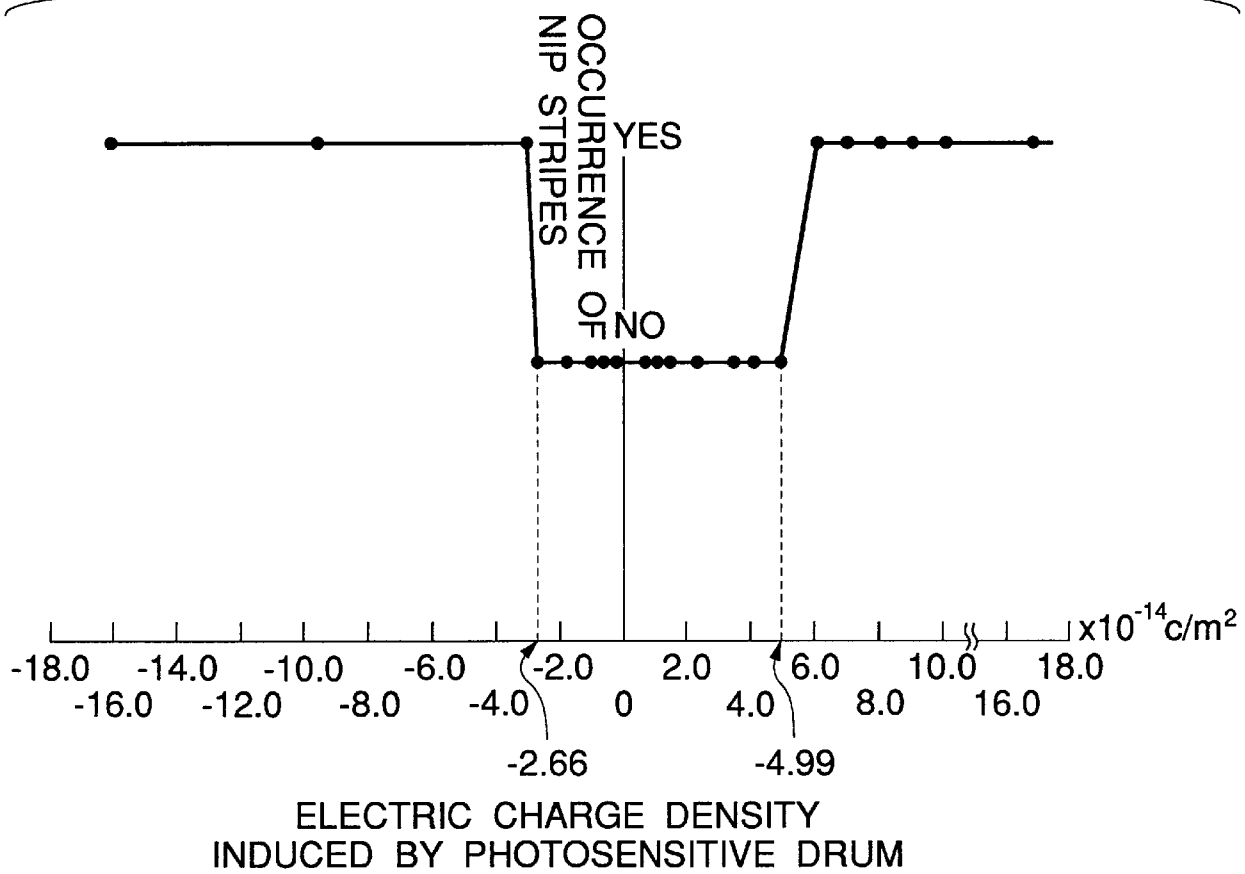
FIG. 9A is a plot showing the relationship between the quantity of electric charge induced in the photosensitive material and a nip stripe resulting from electrostatic hysteresis.

The inventors of the present invention prototyped the image forming apparatus shown in FIGS. 2 and 3. On the assumption that the charge on the front surface of the transfer film 42 is $Q_2$ and the charge on the back surface is $Q_1$, the charges $Q_{10}$ and $Q_{20}$ induced in the photosensitive material layer of the photosensitive drum 20 were calculated by equations (2) and (4). The experiment was conducted in order to obtain the relationship between the charges $Q_{10}$ and $Q_{20}$ and the occurrence of stripes caused by the electrostatic hysteresis phenomenon. FIGS. 9A and 9B show the results and conditions of the experiment.

So long as the density of electric charge induced by the photosensitive drum 20 is in the range of $-2.7\times10^{-14}$–$5.0\times10^{-14}$ C/m$^2$ (FIG. 9A) stripes caused by the electrostatic hysteresis phenomenon do not arise in the photosensitive material layer. Whether or not the photosensitive drum is in contact with transport film 42 is basically not important. The electrostatic hysteresis phenomenon could be prevented from arising in the photosensitive material layer so long as the charges $Q_{10}$ and $Q_{20}$ induced in the photosensitive layer were reduced. According to the conditions of the experiment, the electrode was labeled to a PVdF film and a bias voltage was applied to the electrode. The occurrence of stripes associated with the electrostatic hysteresis phenomenon developed in the photosensitive material layer when the electrode was left in a biased state was tested (FIG. 9B). The stripes developed after the bias voltage has been applied to the electrode four hours were evaluated.

In the present embodiment, charge-removing means for removing charges from the front surface of the transfer material holding number after the completion of the image holding member is used as the induced-charge density removing means. A corotron for peeling purposes, which is positioned to peel the transfer material from the transfer material holding member and receives applied a.c. voltage, is used as a more specific example of the charge removing means.

As is evident from equation (5), reducing the charge $Q_2$ on the front surface of the transfer film 42 as well as reducing the sum of the charges on both sides of the transfer film 42, or ($Q_1+Q_2$), to zero to reduce the density of electric charge induced in the photosensitive material layer.

To this end, it is necessary to improve the charge-removing characteristics or the transfer film 42 of the transfer drum 23. The output of the pair of charge-removing corotrons 37 is increased after the transfer material 24 has been peeled from the transfer drum 23. In order to reduce the density of electric charge to less than a constant level it is necessary to reduce the difference between the charges $Q_1$ and $Q_2$ on both sides of the transfer film 42 to less than a constant level rather than to reduce charges remaining on the surfaces ( $|Q_1+Q_2|$), depending on the type of paper or the number of prints.

It is difficult for the pair of charge-removing corotrons 37 to reduce the charges. That is, when the charges on the transfer film 42 are removed by the pair of charge-removing corotrons 37, the removal of the electric charges is carried out to produce a constant electric potential by means of the field intensity formed by the electric potentials of the pair of corotrons 37 and the transfer film 42. The difference in electric potential between the front side and back side of the transfer film 42 remains constant. For this reason, in the present embodiment, the charges of the transfer film 42 in a floating condition are reduced to a voltage of about zero (the difference in the absolute value of the charge between the front and back sides of the transfer film 42 is small) by the detaching corotron 34 of the peeling section after a cleaning cycle of the transfer film 42.

A toner image having a cyan color is transferred onto a transfer material 24 of the transfer drum 23 in the present embodiment (FIG. 1). Then the transfer drum 23 is further rotated several turns in order to clean the transfer drum 23. The transfer corotron 25 is additionally held in an ON state for the period corresponding to one turn of the transfer drum 23. Further, the detaching corotron 34 and the charge-removing corotron 37 are also turned on. Thus, the charges of the transfer drum 23 are removed. The transfer drum 23 is rotated additional one turn when the cycle of the digital color image forming apparatus is out. Only the a.c. voltage is applied to the detaching corotron 34 at that time. The transfer drum 23 is stopped after the charges on the transfer film 42 of the transfer drum 23 have been removed.

With the above-described construction, it becomes possible for the digital color image forming apparatus of the present embodiment to ensure the prevention of the electrostatic hysteresis phenomenon resulting from the induction of electric charges on the image holding member in the following manner without complicating the construction of the image forming apparatus or increasing costs even if the ambient conditions such as temperatures and humidities change.

Thus, in the digital color image forming apparatus of the present embodiment, black (K), yellow (Y), magenta (M), and cyan (C) toner images formed one on another on the photosensitive drum 20 are transferred on the transfer material 24 adsorbed on the transfer drum 23 in an overlapped manner together with the rotation of the transfer drum 23, as shown in FIG. 3. The transfer material 24 on which a predetermined number of toner images have been transferred is peeled from the surface of the transfer drum 23 by the peeling unit 44. The thus-peeled transfer material 24 is subjected to a fixing operation in the fixing unit 35 so that a color image is formed. The transfer film 42 of the transfer drum 23 is electrostatically charged several times by the transfer corotron 25 in the transfer processes. Hence both sides of the transfer film 42 remain electrostatically charged.

The process of transferring the plurality of toner images sequentially formed on the photosensitive drum 20 are completed in the previously described manner. In synchronism with the separation of the transfer material 24 having the predetermined number of color toner images transferred thereon from the surface of the transfer drum 23 by means of the peeling unit 44, the a.c. voltage on which the d.c. voltage is superimposed on is applied to the detaching corotron 34, so that electric discharge for peeling purposes is produced. As a result, an electrostatic adsorbing force acting between the transfer material 24 and the transfer film 42 of the transfer drum 23 is reduced. Subsequently, the charges on the transfer film 42 of the transfer drum 23 are removed by the pair of charge-removing corotrons 37. The transfer film 42 is then electrostatically charged by the transfer corotron 25 so as to be cleaned. The charges of the transfer film 42 are thus evenly removed. The charges on the transfer film 42 are further removed by application of the a.c. voltage by means of the detaching corotron 34. The transfer film 42 is further subjected to charge-removing operations by the pair of charge-removing corotrons 37. Thus, the charges on both sides of the transfer film 42 of the transfer drum 23 are reduced. However, the difference in charge between the front and back sides of the transfer film 42 still remains.

In the present embodiment, the transfer drum 23 is rotated additional one turn when the cycle of the digital color image forming apparatus is out (FIG. 1). Only the a.c. voltage is applied to the detaching corotron 34 so that the charges on the transfer film 42 of the transfer drum 23 are removed. Thereafter, the transfer drum 23 is stopped.

For this reason, the charges on both sides of the transfer film 42 of the transfer drum 23 are removed by only the discharge of a.c. voltage applied from the detaching corotron 34 to the front side of the transfer film 42. Thus, the difference in charge between the front and back sides of the transfer film 42 can be reduced.

As described above, the digital color image forming apparatus of the present embodiment is provided with the induced-charge density suppressing means for suppressing the density of electric charge that is induced in the area of the photosensitive drum 20 being opposite to the transfer drum 23. This is due to stoppage of the transfer film 42 of the transfer drum 23 which is opposite to the photosensitive drum 20 and is electrostatically charged. By virtue of the suppression of the density of electric charge induced in the area of the photosensitive drum 20, it becomes possible to reliably prevent the electrostatic hysteresis phenomenon that results from the induction of electric charges in the photosensitive drum 20 without increasing costs or complicating the construction of the image forming apparatus, even if ambient conditions such as a temperature or a humidity vary.

The conventional detaching corotron 34 that removes charges from the front surface of the transfer film 42 of the transfer-drum 23 at the end of the image forming processes is used as the induced-charge density suppressing means in the present embodiment. As a result of the conventional peeling corotron 34, it is possible to reliably prevent the electrostatic hysteresis phenomenon of the photosensitive drum 20 without addition of any new members. Therefore, the complication of the construction of the image forming apparatus and an increase in costs are prevented.

The inventors of the present invention prototyped the digital color image forming apparatus, as shown in FIGS. 2 and 3, in order to confirm the effects of the present invention. When the cycle of the image forming apparatus is out the transfer drum 23 was rotated additional one turn. Only an a.c. voltage having an RMS of 5.0 KV and 600 Hz was applied to the detaching corotron 34. The electric charges on transfer film 42 of the transfer drum 23 were removed. The experiment was carried out in order to measure the charges $Q_{10}+Q_{20}$ induced in the photosensitive material layer of the photosensitive drum 20 at a high temperature and a high humidity (in zone A) as well as at a low temperature and a low humidity (in zone C) when the photosensitive drum 20 was stopped at the tie-bar plate 41 and the transfer film 42 of the transfer drum 23.

Figure 10:
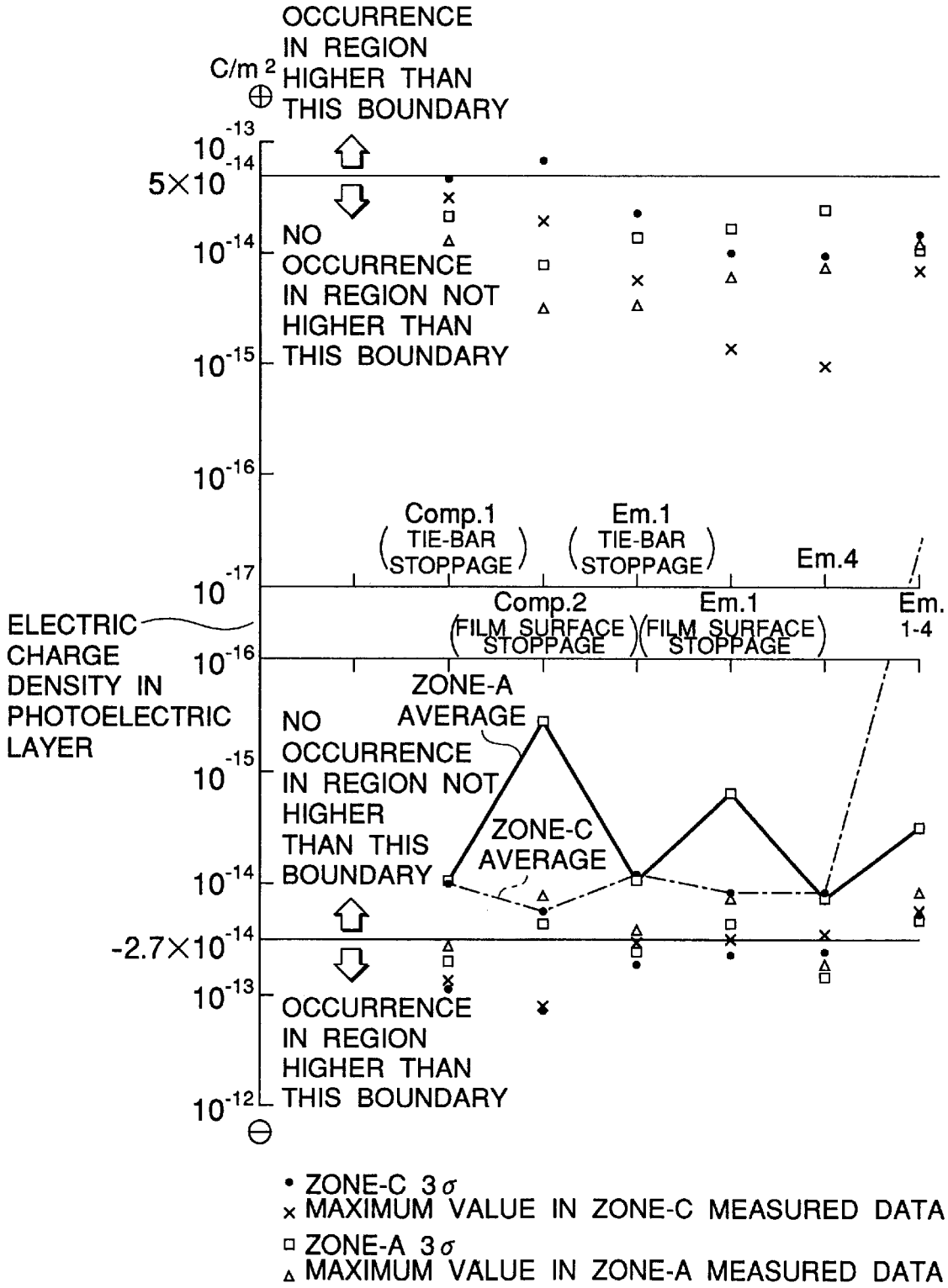
FIG. 10 is a plot showing the relationship between the quantity of electric charge induced in a photosensitive material layer and embodiments and comparative examples of the present invention.

FIG. 10 shows the results of the above-described test. As is evident from the plot, the charges on the transfer film 42 of the transfer drum 23 are removed by applying only an a.c. voltage having an RMS of 5.0 KV (600 Hz) to the detaching corotron 34 when the cycle of the image forming apparatus is out. Thereafter, the photosensitive drum 20 was stopped at the tie-bar plate 41 and the transfer film 42 of the transfer drum 23. The charges $Q_{10}+Q_{20}$ induced in the photosensitive material layer of the photosensitive drum 20 can be suppressed within the range defined from positive to negative (e.g., of $-2.7\times10^{-14}$ to $5.0\times10^{-14}$ C/M$^2$) in which the stripes caused by the electrostatic hysteresis phenomenon of the photosensitive material layer do not arise.

Second Embodiment

Figure 11:
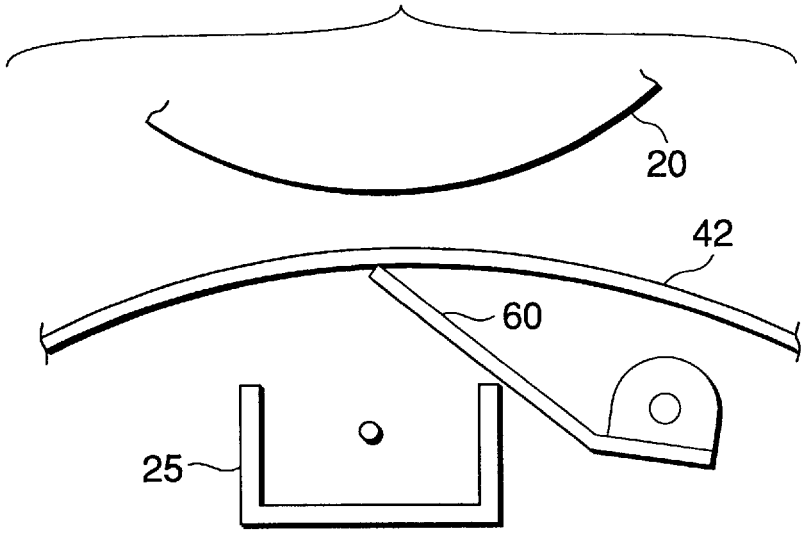
FIG. 11 is a schematic representation showing the principle elements of an image forming apparatus according to another embodiment of the present invention.
Figure 12:
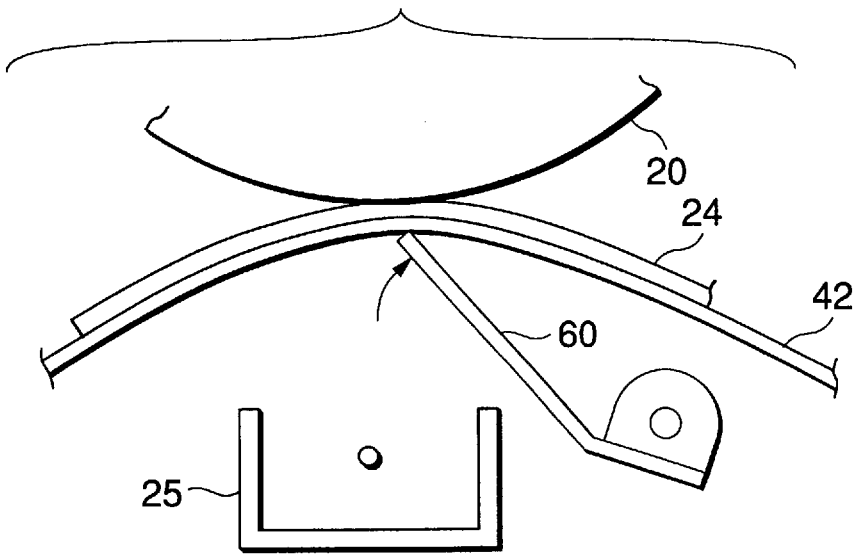
FIG. 12 is a schematic representation showing the operation of the principle elements of the image forming apparatus according to the embodiment shown in FIG. 11.

FIGS. 11 and 12 show an image forming apparatus according to a second embodiment of the present invention. The same features as those of the first embodiment are assigned the same reference numerals. In the second embodiment, the induced-charge density suppressing means comprises retracting means which separates the pressing member for pressing the transfer material holding member against the surface of the image holding member away from the image holding member when the image forming apparatus is in a suspended condition.

The clearance between the photosensitive drum 20 and the transfer film 42 of the transfer drum 23 prevents the electrostatic hysteresis phenomenon from arising in the photosensitive material layer as well as preventing the transfer film 42 from coming into contact with the surface of the photosensitive drum 20 as a result of thermal expansion of the transfer film 42 due to variations in temperatures.

As shown in FIGS. 11 and 12, when the toner images formed on the photosensitive drum 20 are transferred onto the transfer material 24 and retained on the transfer drum 23 by means of the charges for transfer purposes generated by the transfer corotron 25, the electrostatic charges generated by the transfer corotron 25 are concentrated on the transfer area. The transfer material 24 is also retained on the transfer drum 23 being reliably brought into contact with the photosensitive drum 20. To these ends, a transfer baffle 60 made of a synthetic film for pressing the transfer film 42 against the photosensitive drum 20 via the transfer material 24 is disposed behind the transfer film 42 of the transfer drum 23.

The transfer baffle 60 is retractable by means of a solenoid (not shown) between the position where it presses the transfer film 42 against the photosensitive drum 20 and the position where it is separated away from the transfer film 42 in the present embodiment. For example, the transfer baffle 60 is moved to the position where it presses the transfer film 42 against 60 the photosensitive drum 20 after lapse of about 0.5 sec. from when an image forming start button is pressed. Whereas the transfer baffle 60 is separated from the transfer film 42 when the rotation of the photosensitive drum 20 is stopped. Thus, it is possible to reliably prevent the electrostatic hysteresis phenomenon of the photosensitive drum 20 by means of a simple structure (e.g., the retracting means) for separating the transfer baffle 60 away from the photosensitive drum 20.

The image forming apparatus of the second embodiment is the same as that of the first embodiment in other respects such as operation and construction, and its explanation will be omitted here.

Third Embodiment

Figure 13:
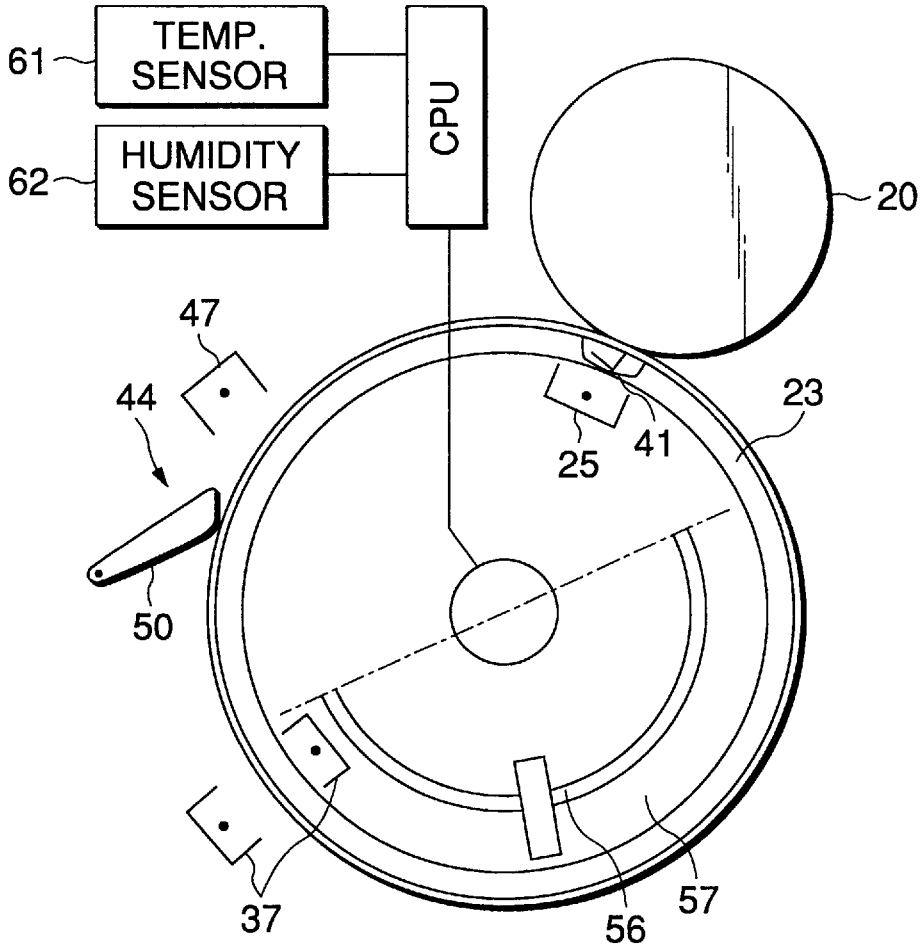
FIG. 13 is a schematic representation showing the principle elements of an image forming apparatus according to still another embodiment of the present invention.

FIG. 13 shows an image forming apparatus according to a third embodiment of the present invention. The same features as those of the first embodiment are assigned the same reference numerals, and their explanations will be omitted here. In the third embodiment, the induced-charge density suppressing means comprises stop position changing means for changing the position on the basis of at least one of detected results (e.g., a temperature and a humidity). This happens when the transfer material holding member is stopped while being opposite to the image holding member.

A temperature sensor 61 and a humidity sensor 62 are disposed in the image forming apparatus for detecting temperatures and humidities in the third embodiment (FIG. 13). The position where the transfer drum 23 is stopped is changed on the basis of the results of the temperature and humidity sensors 61 and 62.

According to the experiments conducted by the inventors (described above) some combination (e.g. high temperature and high humidity and low temperature and low humidity) of the conditions results in no electrostatic hysteresis phenomenon arising in the photosensitive drum 20 depending on the position where the transfer drum 23 is stopped while being opposite to the photosensitive drum 20 in both the set of high temperatures and humidities and the set of low temperatures and humidities.

If the transfer drum 23 was stopped on the tie-bar plate 41 at a low temperature and a low humidity (FIG. 13) the electrostatic hysteresis phenomenon did not arise in the photosensitive layer of the photosensitive drum 20. Further, if the transfer drum 23 was stopped on the transfer film 42 other than the tie-bar plate 41 at a high temperature and a high humidity, the electrostatic hysteresis phenomenon did not arise in the photosensitive material layer.

For these reasons, the image forming apparatus of the present embodiment is arranged on the basis of the results of detection of the temperature and humidity sensors in such a way that the transfer drum 23 is stopped on the tie-bar plate 41 at a low temperature and a low humidity. The transfer drum 23 is stopped on the transfer film 42 other than the tie-bar plate 41 at a high temperature and a high humidity. Thus, if the position where the transfer drum 23 is stopped while being opposite to the photosensitive drum 20 is changed on the basis of at least one of the detected results (e.g., temperature and humidity), it is possible to reliably prevent the electrostatic phenomenon without complicating the construction of the image forming apparatus or increasing costs, even if the ambient conditions change.

The image forming apparatus of the third embodiment is the same as that of the first embodiment in other respects such as construction and operation, and hence its explanation will be omitted here.

Fourth Embodiment

Figure 14:
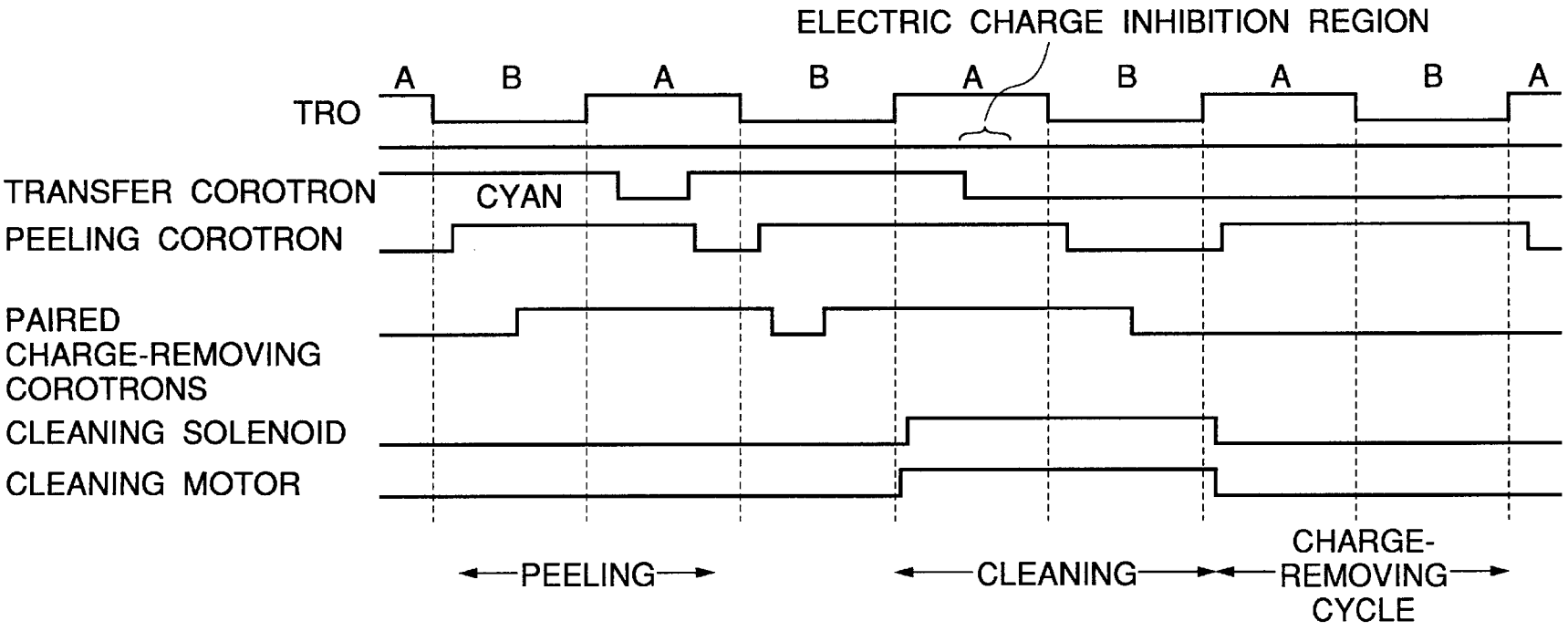
FIG. 14 is a timing chart that shows the operation of the image forming apparatus according to still another embodiment of the present invention.

FIG. 14 shows an image forming apparatus according to a fourth embodiment of the present invention. The same features as those of the previous embodiments are assigned the same reference numerals and their explanations will be omitted here.

In the fourth embodiment, the induced-charge density suppressing means for suppressing the density of electric charge induced in the area of the image holding member which is opposite to the transfer material holding member comprises an electric charge prohibiting means. The electric charge prohibiting means prohibits the transfer means from electrically charging the area of the transfer material holding means which is opposite to the image holding means when the transfer material holding means is stopped.

The transfer material holding member is provided with a drum-shaped frame which is made up of a pair of annular members disposed on both longitudinal ends of the drum-shaped frame. A joint member for connecting the annular members to each other is also provided. Additionally, a transfer film is wrapped around the drum-shaped frame. Lastly the position where the transfer material holding member is stopped while it is opposite to the image holding member is set so that the joint member of the transfer material holding member is positioned in an upstream direction in the direction of the movement of the transfer material holding member with respect to the line between the centers of the image holding member and the transfer material holding member.

The transfer drum 23 is cleaned after a cyan toner image has been transferred onto the transfer material 24 retained on the transfer drum 23 (FIG. 14). For this reason, the transfer drum 23 is further rotated a plurality of turns, and the transfer corotron 25 is additionally held in the ON state for the period corresponding to one rotation of the of the transfer drum 23. Further, the detaching corotron 34 and the pair of charge-removing corotrons 37 are also turned on, whereby the charges on the transfer drum 23 are removed. When the cycle of the image forming apparatus is out, the transfer drum 23 is rotated one additional turn. Only the a.c. voltage of the detaching corotron 34 is turned on in that case, so that the charges on the transfer film 42 of the transfer drum 23 are removed. Thereafter, the transfer drum 23 is stopped.

When the transfer corotron 25 is additionally held in the ON state for the period corresponding to one rotation-of the transfer drum 23, the area of the transfer drum 23 that is opposite to the photosensitive drum 20 when the transfer drum 23 is stopped is prevented from being electrostatically charged by the transfer corotron 25. The timing at which the charging operation of the transfer corotron 25 is inhibited is set so as to correspond to the rotational speed of the transfer drum 23, as required. While the transfer drum 23 is in a stationary condition, the timing at which the transfer drum 23 is stopped is set so that the last area of the transfer drum 23 that is not electrostatically charged by the transfer corotron 25 is opposite to the photosensitive drum 20 when the transfer drum 23 is stopped. Thus, it is possible to reliably prevent the electrostatic hysteresis phenomenon of the image holding member without addition of any new members.

Figure 15:
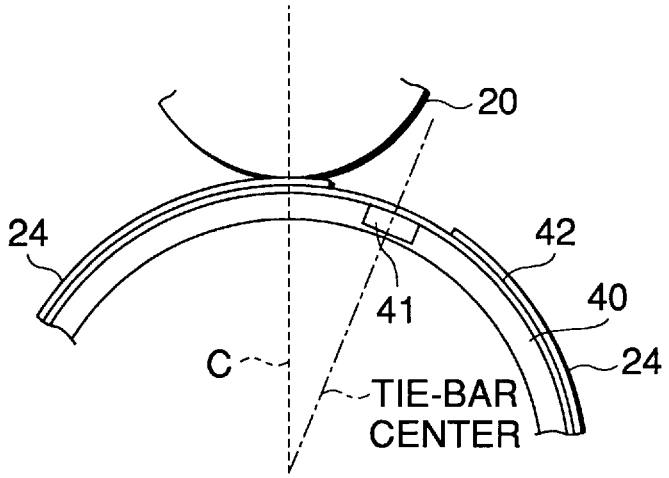
FIG. 15 is a schematic representation showing the principle elements of an image forming apparatus according to yet another embodiment of the present invention.
Figure 16:
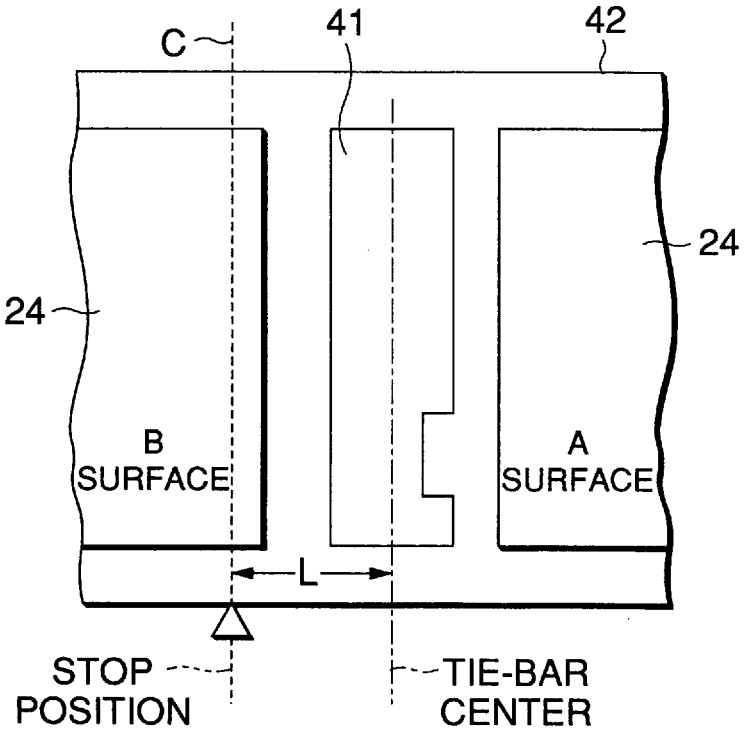
FIG. 16 is an exploded view of the image forming apparatus shown in FIG. 15.

In the fourth embodiment, as shown in FIGS. 15 and 16, the area of the transfer drum 23 which is opposite to the photosensitive drum 20 when the transfer drum 23 is stopped is set such that the center of the tie-bar plate 41 of the transfer drum 23 is separated away from the center line C connecting together the centers of the photosensitive drum 20 and the transfer drum 23, by only a distance L upstream in the direction of the movement of the transfer drum 23. This distance L is determined in consideration of the following:

(1) the tie-bar plate 41 is avoided when the transfer drum 23 is stopped so as to be able to remove charges from both sides of the transfer film 24 using the detaching corotron 34;

(2) the previously described position is situated close to the rear edge of the transfer material 24 so that the transfer corotron 25 can be turned off during the cleaning cycle of the transfer drum 23; and (3) the tie-bar plate 41 is prevented from coming to a stop on the optical axis of a sensor 65 (FIG. 3) disposed in the transfer drum 23 for detecting the transfer material 24 of the transfer material transportation path (in order to prevent erroneous detection of a transfer material when copy operations are started).

The transfer drum 23 is provided with a drum-shaped frame which is made up of the pair of ring members 40 disposed on both longitudinal ends of the drum-shaped frame. The tie-bar plate 41 for connecting the ring members 40 to each other is also provided. The transfer film is wrapped around the drum-shaped frame. The area of the transfer drum 23 that is opposite to the photosensitive drum 20 when the transfer drum 23 is stopped is set so that the tie-bar plate 41 of the transfer drum 23 is positioned in an upstream direction in the direction of the movement of the transfer drum 23 with respect to the line C between the centers of the photosensitive drum 20 and the transfer drum 23. As a result of the shift of the area of the transfer drum 23 (that is opposite to the photosensitive drum 20 when the transfer drum 23 is stopped, away from the tie-bar plate 41 of the transfer drum 23), the density of electric charge induced in the area of the photosensitive drum 20 that is opposite to the transfer drum 23 can be suppressed. Further, the area of the transfer drum 23 that is opposite to the photosensitive drum 20 when the transfer drum 23 is stopped is set so that the tie-bar plate 41 of the transfer drum 23 is positioned in an upstream direction in the direction of the movement of the transfer drum 23 with respect to the line C between the centers of the photosensitive drum 20 and the transfer drum 23. As a result, the image forming of the first transfer material 24 can be started early, which makes it possible to improve the productivity of the image forming operation.

Figure 17:
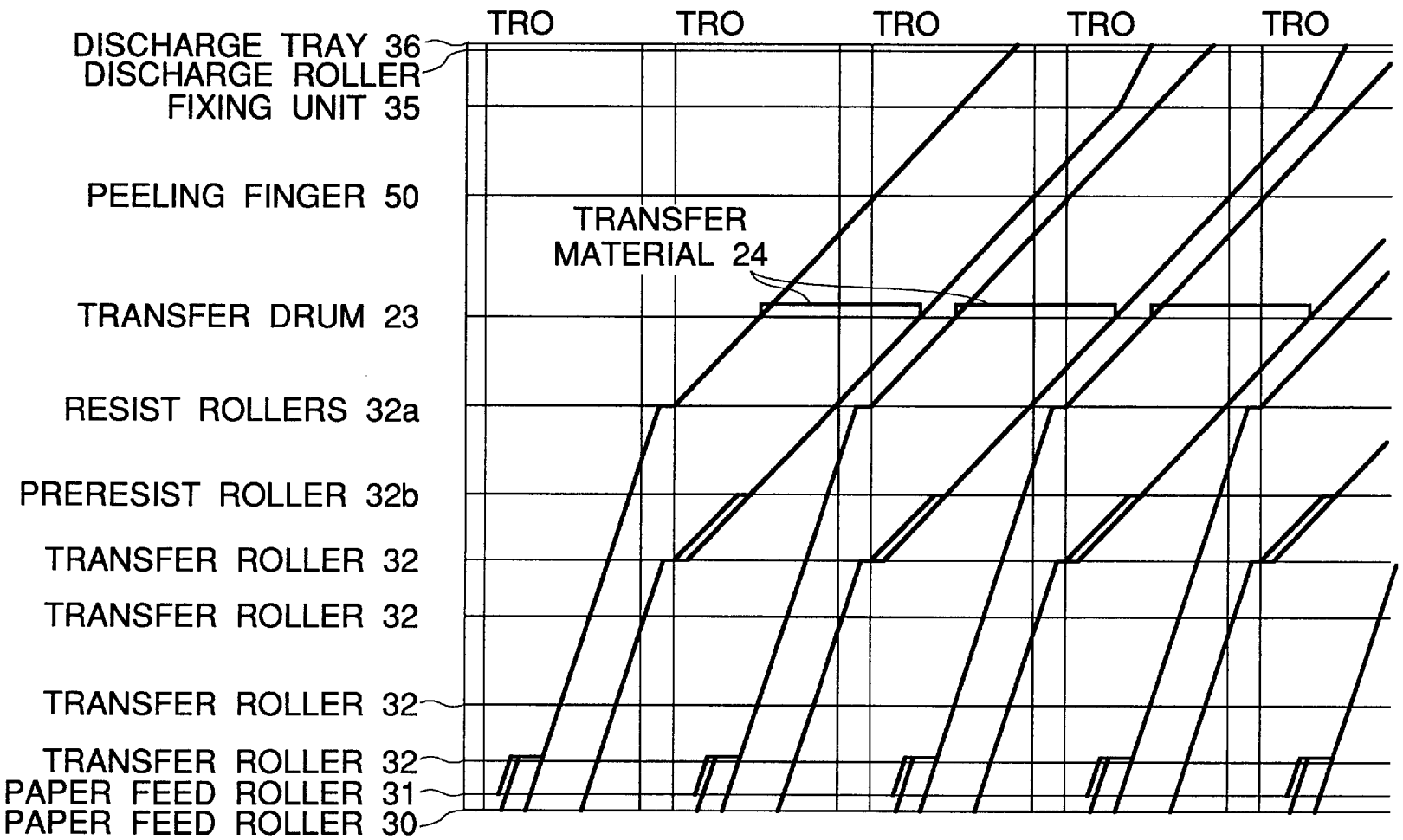
FIG. 17 is a timing chart that shows the transportation of a transfer material.

The area of the transfer drum 23 is set so that the tie-bar plate 41 of the transfer drum 23 is positioned in an upstream direction. That is, in the direction of the movement of the transfer drum 23 with respect to the line between the centers of the photosensitive drum 20 and the transfer drum 23. The feeding of the transfer material 24 can be started on the basis of the reference signal (TRO) first generated by the reference signal generator while the transfer drum 23 is in a slightly rotated state (FIG. 17). Thus, the image forming of the first transfer material 24 can be started early which makes it possible to improve the productivity of the image forming operation.

In contrast, if the area of the transfer drum 23 that is opposite to the photosensitive drum 20 when the transfer drum 23 is stopped, is set so that the tie-bar plate 41 of the transfer drum 23 is positioned in a downstream direction in the direction of the movement of the transfer drum 23 with respect to the line between the centers of the photosensitive drum 20 and the transfer drum 23. It is necessary for the transfer drum 23 to rotate about half turn until the reference signal is first generated by the reference signal generator, and therefore the image forming of the first transfer material 24 is delayed accordingly.

The inventors of the present invention prototyped the digital color image forming apparatus (FIGS. 2 and 3), in order to confirm the effects of the above-described embodiment. When the cycle of the image forming apparatus is out, the transfer corotron 25 is prevented from electrostatically charging the area of the transfer drum 23 that is opposite to the photosensitive drum 20. The test was conducted to measure the charges $Q_{10}+Q_{20}$ induced in the photosensitive material layer of the photosensitive drum 20 at a high temperature and a high humidity as well as at a low temperature and a low humidity under the above-described condition.

FIG. 10 shows the results of the above-described experiments. As seen from the plot, the charges $Q_{10}+Q_{20}$ induced in the photosensitive material layer of the photosensitive drum 20 can be suppressed within the range defined from positive to negative (e.g., range of $-2.7\times10^{-14}$ to $5.0\times10^{-14}$ $C/m_2$) . In this image the stripes caused by the electrostatic hysteresis phenomenon of the photosensitive material layer do not arise. As a result, the electrostatic hysteresis phenomenon of the photosensitive material layer can be prevented.

In FIG. 10 the combination of the first and fourth embodiments are combined. The results of this experiment reveal that the charges $Q_{10}+Q_{20}$ induced in the photosensitive material layer can be reliably suppressed within the range $-2.7\times10^{-14}$ to $5.0\times10^{-14}$ $C/m^2$. In this range, the stripes caused by the electrostatic hysteresis phenomenon of the photosensitive material layer do not arise.

The image forming apparatus of the fourth embodiment is the same as that of the first embodiment in other respects such as construction and operation, and hence its explanation will be omitted here.

Fifth Embodiment

Figure 18:
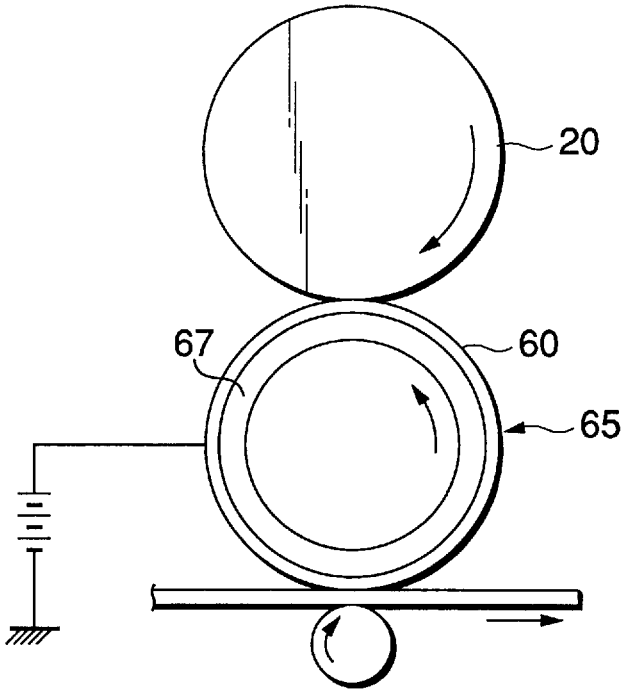
FIG. 18 is a schematic representation of the principle elements of an image forming apparatus according to a further embodiment of the present invention.

FIG. 18 shows an image forming apparatus according to a fifth embodiment of the present invention. The same features as those of the previous embodiments are assigned the same reference numerals and their explanations will be omitted here.

In the fifth embodiment the transfer means comprises an intermediate roller having a resistance layer provided on the front side and a conductive layer provided on the back side. The toner images are transferred by application of a bias voltage to the conductive layer of the intermediate transfer roller.

An intermediate transfer roller 65 which is in contact with, or in close proximity to, the photosensitive roller 20 is used in lieu of the transfer drum (FIG. 18). A plurality of toner images are once superimposed one on another on the intermediate transfer roller 65. These color toner images are transferred onto the transfer material 24 in a collected manner.

The intermediate transfer roller 65 is made up of a resistance layer 66 provided on the front side and a conductive 67 layer provided on the back side. The toner images are transferred by application of a bias voltage to the conductive layer 67 of the intermediate transfer roller 65.

The image forming apparatus of the fifth embodiment is the same as that of the first embodiment in other respects such as construction and operation, and hence its explanation will be omitted here.

Sixth Embodiment

Figure 19:
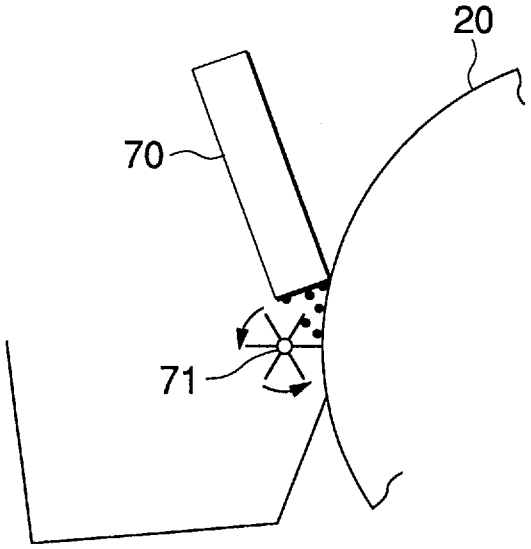
FIG. 19 is a schematic representation of the principle elements of an image forming apparatus according to a yet further embodiment of the present invention.
Figure 20:
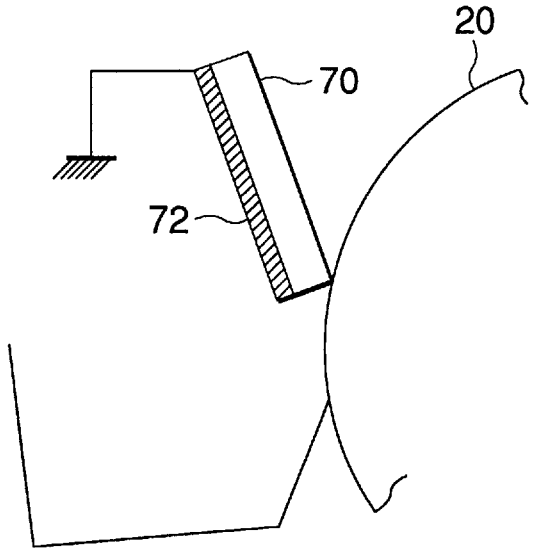
FIG. 20 is a schematic representation of the principle elements of an image forming apparatus according to a furthermore embodiment of the present invention.
Figure 21:
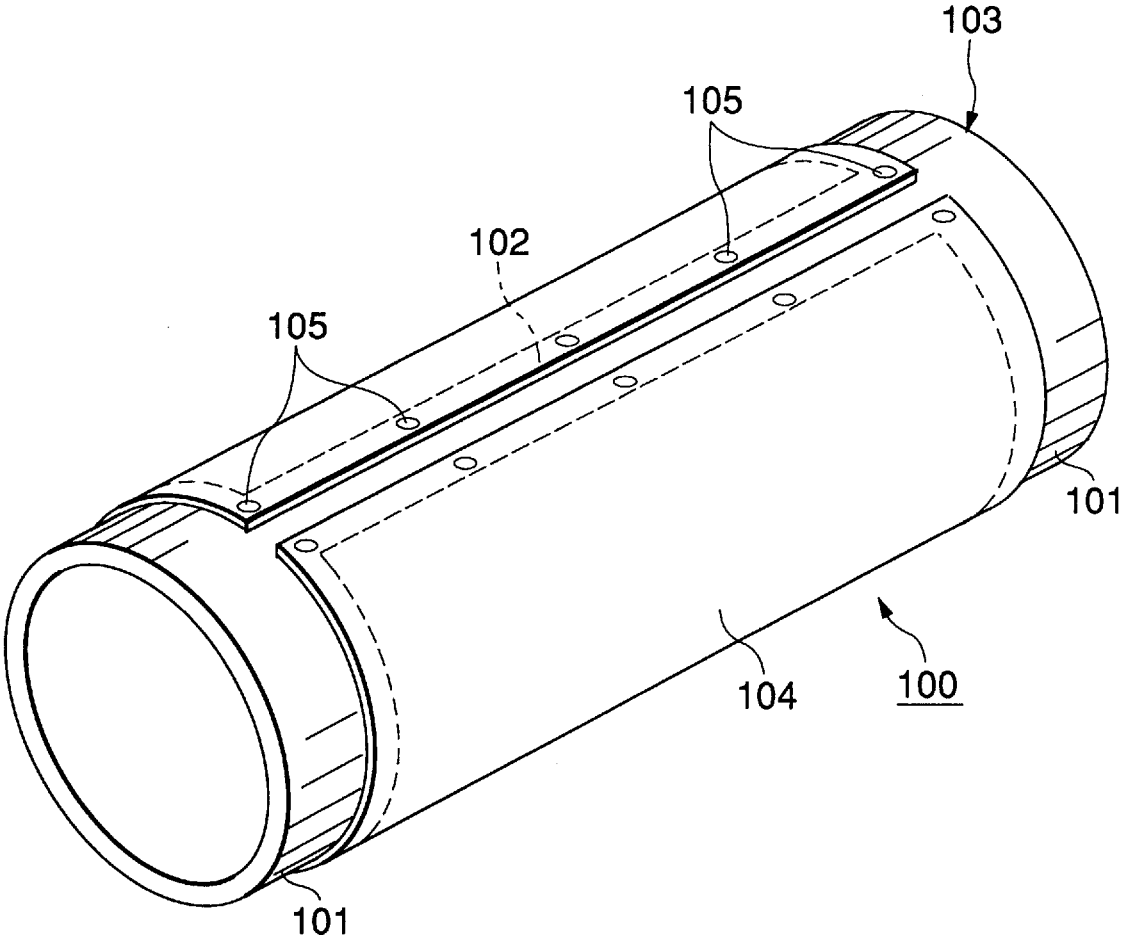
FIG. 21 is a perspective view of a transfer drum of a conventional image forming apparatus.
Figure 22A:
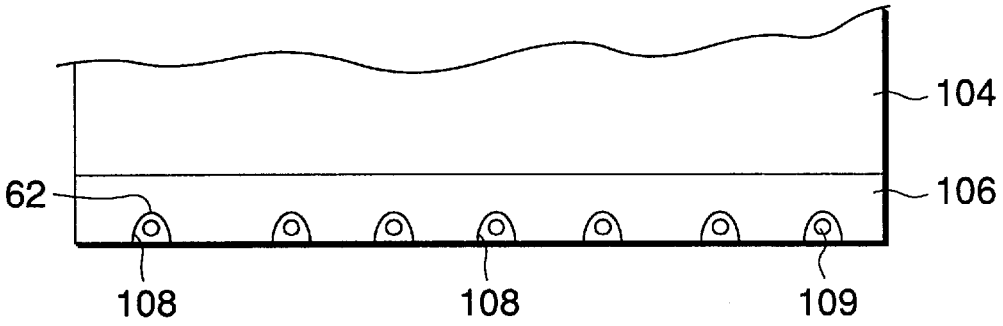
FIG. 22A is a plan view of the edge of the transfer drum.
Figure 22B:
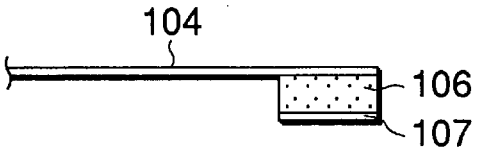
FIG. 22B is a cross-sectional view of the same.
Figure 23:
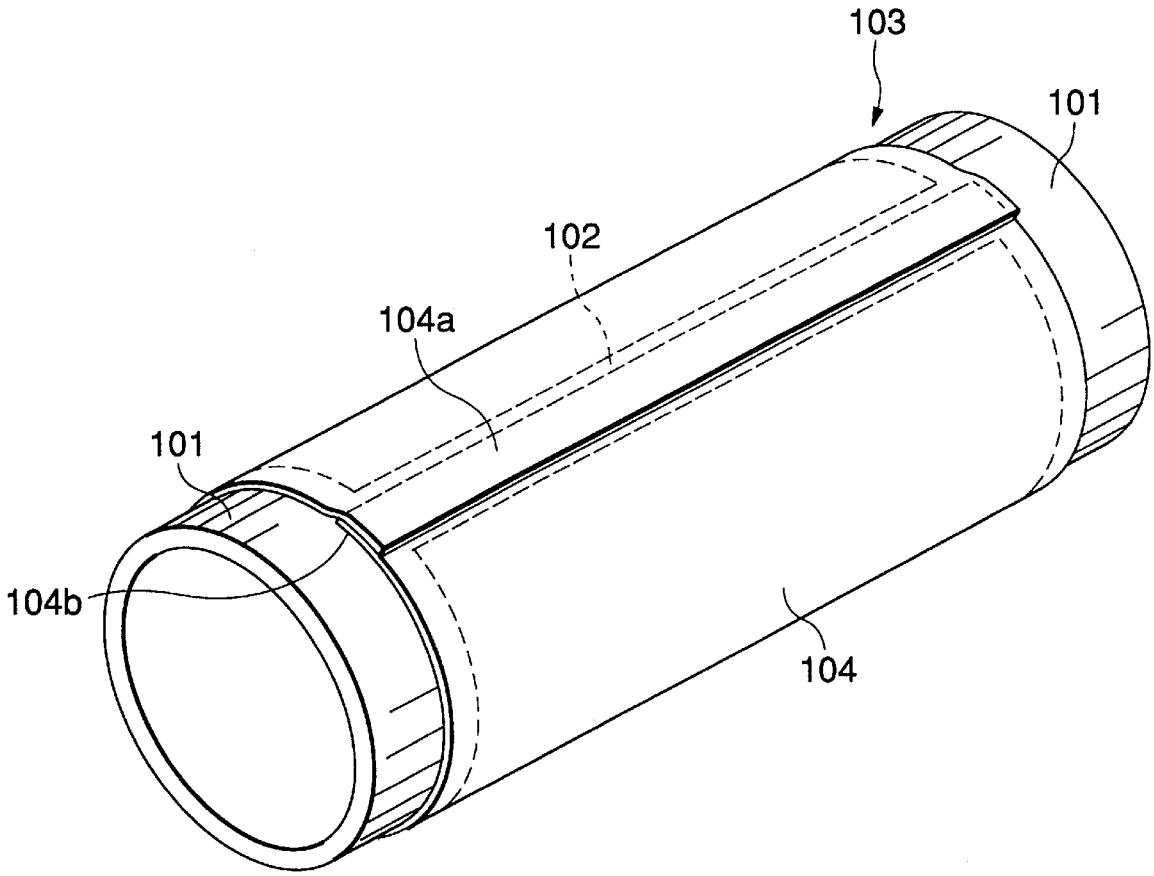
FIG. 23 is a perspective view of anther transfer drum used in the conventional image forming apparatus.
Figure 24:
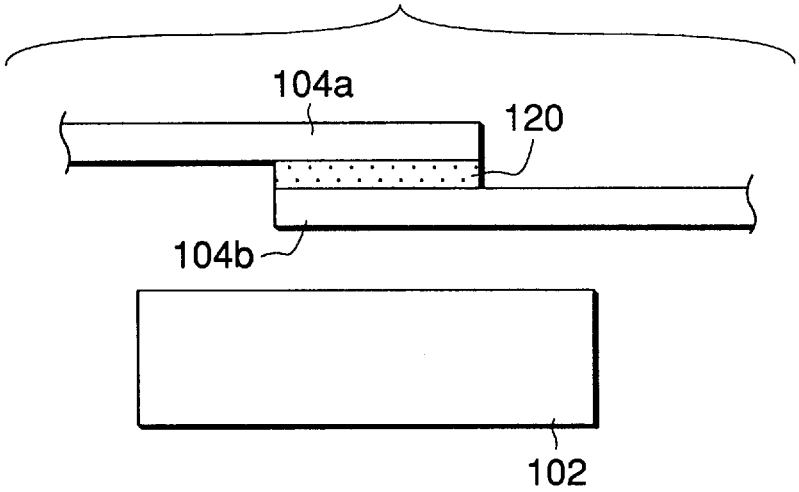
FIG. 24 is a cross-sectional view of the principle elements of the transfer drum.
Figure 25:
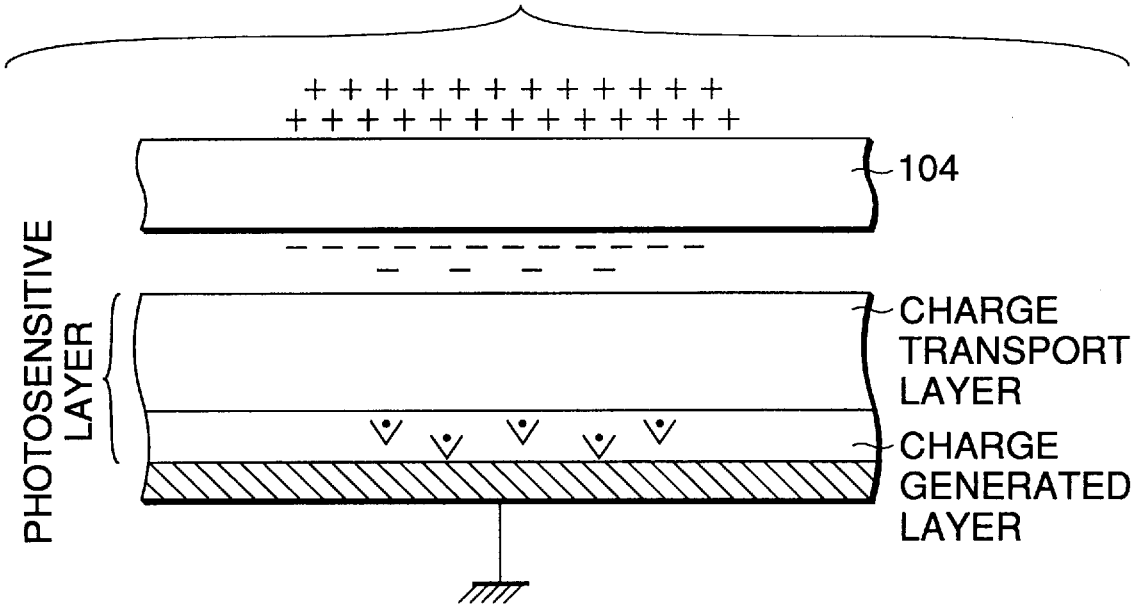
FIG. 25 is a diagrammatic representation showing the principle of development of electrostatic hysteresis in the photosensitive material layer.

FIGS. 19 and 20 show an image forming apparatus according to a sixth embodiment of the present invention. The same features as those of the previous embodiments are assigned the same reference numerals and their explanations will be omitted here.

In the sixth embodiment the image forming member that is opposite to the image holding member and is electrostatically charged is a cleaning blade. The image forming member is provided with induced-charge density suppressing means for suppressing the density of electric charge induced in the area of the image holding member which is opposite to the cleaning blade.

The cleaning unit removes the toner remaining on the surface of the photosensitive drum 20 and provided with a cleaning blade 70 (FIG. 19). Untransferred charged toner remain on the cleaning blade 70 and the amount of untransferred charged toner deposited on the leading edge of the cleaning blade 70 increases as a full-color image forming operation continues. It may be considered that the residual toner brings about the electrostatic hysteresis phenomenon in the photosensitive material layer of the photosensitive drum 20.

Instead of attaching a rotary brush to the leading edge of the cleaning blade 70, a conductive layer 72 may be attached to the back side of the cleaning blade 70. Alternatively, an electrical conductivity may be directly afforded to the cleaning blade 70.

The induced-charge density suppressing means comprises removing means for removing the toner deposited on the cleaning blade. As a result of the charged toner being deposited on the cleaning blade, it is possible to reliably prevent the electrostatic hysteresis from developing.

The image forming apparatus of the sixth embodiment is the same as that of the first embodiment in other respects such as construction and operation, and hence its explanation will be omitted here.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

an image forming member for forming an image;

an image holding member opposite the image forming member onto which a developed image is formed;

transfer means for transferring the developed image formed on said image holding member onto a transfer material; and induced-charge density suppressing means for suppressing induced electric charge in an area substantially between said holding member and said transfer means, thereby preventing an electrostatic hysteresis phenomenon on said image holding member that results from the induced electric charge in said image holding member, said induced-charge density suppressing means including charge-removing means for removing electric charges from an outer surface of the transfer means by an a.c. voltage applying means applied solely to the outer surface, said a.c. voltage applying means being maintained on for a first period of time after removal of the transfer material from said transfer means.

2. The image forming apparatus of claim 1, wherein said induced-charge density suppressing means for suppressing the density of electric charge induced in the area is arranged so as to suppress the density of electric charge induced in said image holding member to $-2.7\times10^{-14}$ to $5.0\times10^{-14}$ $C/m^2$.

3. The image forming apparatus of claim 1, wherein said induced-charge density suppressing means further includes a corotron acting on the outer surface and an inner surface of said transfer material holding member, said corotron being applied for a second period of time after removal of the transfer material from said transfer material holding member, the second period of time being less than the first period of time.

4. The image forming apparatus of claim 3, wherein said corotron substantially reduces a difference in absolute value between electric charges on the outer surface and the inner surface.

5. The image forming apparatus of claim 1, wherein the a.c. voltage is about 5 KV at about 600 Hz.

6. The image forming apparatus of claim 1, wherein said a.c. voltage applying means is an a.c. corotron.

7. The image forming apparatus of claim 6, wherein said a.c. corotron also peels the transfer material from said transfer material holding member.

8. An image forming apparatus, comprising:

an image holding member on which a plurality of toner images having different colors are formed one over another;

a transfer material holding member opposite the image holding member for retaining a transfer material;

transfer means disposed in said transfer material holding member and having an electrostatic charge for transferring the toner images formed on said image holding member onto the transfer material retained on said transfer material holding member while the toner images are retained in a stacked state;

induced-charge density suppressing means for suppressing induced electric charge resulting from stoppage of the transfer material holding member in an area substantially between said image holding member and said transfer material holding member, thereby preventing an electrostatic hysteresis phenomenon on said image holding member that results from an induction of electric charges in said image holding member, said induced-charge density suppressing means including charge-removing means for removing electric charges from an outer surface of said transfer material holding member by an a.c. voltage applying means applied solely to the outer surface, said a.c. voltage applying means being maintained on for a first period of time after removal of the transfer material from said transfer material holding member.

9. The image forming apparatus as defined in claim 8, wherein said charge-removing means is made up of a charge-removing corotron which is positioned so as to peel the transfer material from said transfer material holding member and receives an applied a.c. voltage.

10. The image forming apparatus of claim 8, wherein said induced-charge density suppressing means further includes a corotron acting on the outer surface and an inner surface of said transfer material holding member, said corotron being applied for a second period of time after removal of the transfer material from said transfer material holding member, the second period of time being less than the first period of time.

11. The image forming apparatus of claim 10, wherein said corotron substantially reduces a difference in absolute value between electric charges on the outer surface and the inner surface.

12. The image forming apparatus of claim 8, wherein the a.c. voltage is about 5 KV at about 600 Hz.

13. The image forming apparatus of claim 8, wherein said induced-charge density suppressing means for suppressing the density of electric charge induced in the area is arranged so as to suppress the density of electric charge induced in said image holding member to $-2.7\times10^{-14}$ to $5.0\times10^{-14}$ $C/m^2$.

* * * * *